US006878952B1

(12) United States Patent
Ohsono et al.

(10) Patent No.: US 6,878,952 B1
(45) Date of Patent: Apr. 12, 2005

(54) CASK

(75) Inventors: Katunari Ohsono, Hyogo (JP); Kouiti Ue, Hyogo (JP); Toshihiro Matsuoka, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 548 days.

(21) Appl. No.: 09/830,851

(22) PCT Filed: Sep. 4, 2000

(86) PCT No.: PCT/JP00/05980

§ 371 (c)(1),
(2), (4) Date: May 2, 2001

(87) PCT Pub. No.: WO01/18823

PCT Pub. Date: Mar. 15, 2001

(30) Foreign Application Priority Data

Sep. 2, 1999 (JP) ..... 11-249314

(51) Int. Cl.[7] ..... G21F 5/00

(52) U.S. Cl. ..... 250/506.1; 250/507.1; 376/272

(58) Field of Search ..... 250/506.1, 507.1; 376/272

(56) References Cited

U.S. PATENT DOCUMENTS 4,752,437 A * 6/1988 Ito et al. ..... 376/272
4,997,618 A * 3/1991 Efferding ..... 376/272
5,015,863 A * 5/1991 Takeshima et al. ..... 250/506.1
5,063,299 A * 11/1991 Efferding ..... 250/507.1
5,373,540 A 12/1994 DeCooman, Sr. et al.

FOREIGN PATENT DOCUMENTS

| | | |
|---|---|---|
| JP | 61-203398 | 12/1986 |
| JP | 62-242725 | 10/1987 |
| JP | 2-113200 | 9/1990 |
| JP | 4-357498 | 12/1992 |
| JP | 9-159796 | 6/1997 |
| JP | 9-510545 | 10/1997 |
| WO | WO 95/26029 | 9/1995 |

* cited by examiner

*Primary Examiner*—Kiet T. Nguyen
(74) *Attorney, Agent, or Firm*—Oblon, Spivak, McClelland, Maier & Neustadt, P.C.

(57) ABSTRACT

Resin (106) for shielding neutrons is provided at the outer periphery of a shell main body (101) that shields the γ-rays. Basket (130) is constructed of a plurality of angular pipes (132) having neutron absorbing property. The inside of a cavity (102) of the shell main body (101) is processed to match its shape with the external shape of the basket (130), and the angular pipes (132) are inserted into this cavity (102) to be brought into contact with the inner surface of the cavity (102). Used nuclear fuel aggregates are accommodated and stored in latticed cells structured by the angular pipes (132). Thermal conductivity of decay heat generated from the used nuclear fuel aggregates is improved as the outer surface of the angular pipes (132) and the inner surface of the cavity (102) are in direct contact with each other.

13 Claims, 20 Drawing Sheets

CASK

TECHNICAL FIELD

The present invention relates to a cask for accommodating and storing used nuclear fuel aggregates after the nuclear fuel has been combusted. This invention relates to a cask having improved thermal conductivity and higher accommodation capacity, being compact in size and light in weight.

BACKGROUND ART

A nuclear fuel aggregate that is at a final stage of a nuclear fuel cycle and that has finished combustion and cannot be used any more is called a used nuclear fuel aggregate. The used nuclear fuel aggregate includes a high radioactive material such as FP and is therefore necessary to be thermally cooled. For this purpose, the used nuclear fuel aggregate is cooled in a cooling pit at a nuclear power plant during a predetermined period of time (3 to 6 months). Thereafter, the cooled used nuclear fuel aggregate is accommodated in a cask that is a shielding vessel, and the used nuclear fuel aggregate accommodated in the cask is carried to a reprocessing facility by a track and the like, and is stored there. For accommodating the used nuclear fuel aggregate into the cask, a holding element having a latticed cross section called a basket is used. Each used nuclear fuel aggregate is inserted into each of cells that are a plurality of accommodation spaces formed in the basket. With this arrangement, a proper holding force is secured for holding the used nuclear fuel aggregate against vibrations during the transportation.

As prior examples of such a cask, various kinds of casks have been disclosed in, for example, the "Nuclear Eye (in Japanese), Nikkan Kogyo Shuppan Production, issued on Apr. 1, 1998, and Japanese Patent Application Laid-open Publication No. 62-242725. A cask based on which the present invention has been made will be explained below. It should be noted that this cask is shown for the convenience of the explanation, and does not correspond to a publicly known or publicly used one.

FIG. 19 is a perspective view showing one example of a cask. FIG. 20 is a cross-sectional view of the cask cut along an axial direction of the cask shown in FIG. 19. A cask 500 is constructed of a cylindrical shell main body 501, resin 502 as a neutron shielding unit provided on an outer periphery of the shell main body 501, an external cylinder 503, a bottom section 504, and a lid section 505. The shell main body 501 and the bottom section 504 have been forged from carbon steel as γ-rays shielding units. The lid section 505 consists of a primary lid 506 and a secondary lid 507 made of stainless steel or the like. The shell main body 501 and the bottom section 504 are connected together by butt-welding. The primary lid 506 and the secondary lid 507 are fixed to the shell main body 501 by bolts made of stainless steel. A metal-made O-ring exists between the lid section 505 and the shell main body 501, thereby holding an airtight condition inside the used nuclear fuel aggregate.

Between the shell main body 501 and the external It cylinder 503, a plurality of internal fins 508 are provided for carrying out a thermal conduction. Copper is used for the internal fin 508 to increase the thermal conductivity. The resin 502 is injected in a fluid state into spaces formed by the internal fins 508, and is cooled and solidified afterward. The basket 509 has a structure of having 69 angular pipes 510 assembled in a bundle as shown in FIG. 19, and is inserted into a cavity 511 of the shell main body 501 in a constrained state.

The angular pipes 510 are made of aluminum alloy having neutron absorbing material (e.g. boron: B) mixed into it in order to avoid the used nuclear fuel aggregate from reaching a criticality. On both sides of a cask main body 512, trunnions 513 (one is not shown in the drawing) are provided for suspending the cask 500. Further, on both ends of the cask main body 512, there are installed buffers 514 (one is not shown in the drawing) that have wood built inside thereof as a buffering material.

When actually manufacturing the cask 500, it is usually necessary to investigate on design conditions such as the number of used nuclear fuel aggregates, and their sizes and weights, etc. Specifically, it is preferable that the cask can accommodate a large number of used nuclear fuel aggregates, has a small external diameter, and has light-weight. However, according to the structure of the above cask 500, as the angular pipes 510 are in line contact with the inner surface of the cavity 511 at the outermost periphery, a space area S is formed between the basket 509 and the cavity 511. Therefore, the thermal conduction from cells 515 to the shell main body 501 cannot be carried out efficiently. Further, as the diameter of the shell main body 501 becomes large because of the existence of the space area S, the cask 500 has a heavy weight.

On the other hand, the volume of radiation that is leaked to the outside of the cask is prescribed by the total volume of neutron and γ-rays. Therefore, in order to reduce the weight of the cask 500, the thickness of the shell main body 501 maybe made smaller. However, because of the γ-rays shielding unit, the cask is required to have a thickness that is sufficient enough to secure a γ-rays shielding function at the shell main body 501 side. While the cask 500 can accommodate the unconventional number of 69 fuel assemblies, this number of accommodating the used nuclear fuel aggregates is reduced when the diameter of the shell main body 501 is made smaller in the structure to accommodate the used nuclear fuel aggregates within a predetermined weight.

It is an object of the present invention to provide a cask that has any one of the following. That is, improved thermal conductivity, higher accommodation capacity, compact size, and light weight.

DISCLOSURE OF THE INVENTION

The cask according to this invention has the shape of the inside of a cavity of a shell main body that has a neutron shielding unit at its outer periphery and shields the γ-rays is matched with the external shape of a basket that has latticed cells structured by a plurality of angular pipes having neutron absorbing property, whereby each used nuclear fuel aggregate is accommodated in each cell of the basket inserted into the cavity.

Each used nuclear fuel aggregate generates a radiation and has decay heat. The used nuclear fuel aggregates are accommodated into the cells of the basket structured by angular pipes. The shape of the inside of the cavity of the shell main body is matched with the external shape of the basket. Therefore, when the basket is inserted into the cavity, the angular pipes at the outside are brought into a plane contact with the inner surface of the cavity. As the shape of the inside of the cavity is matched with the external shape of the basket, no space area is generated between the angular pipes and the cavity. Therefore, the decay heat is efficiently conducted from the basket to the shell main body.

Further, as there is no space area inside the cavity, it is possible to make smaller the external diameter of the shell main body. On the other hand, when the external diameter of the shell main body is made the same as that of the shell main body as shown in FIG. 19, it becomes possible to insert more angular pipes. As the angular pipes have the neutron absorbing property, the angular pipes do not reach the criticality when the angular pipes have accommodated the used nuclear fuel aggregates. The γ-rays that has been generated from the used nuclear fuel aggregates is shielded by the shell main body, and at the same time, neutron is shielded by the neutron shielding unit.

According to the cask of next invention, in the cask of the above-mentioned invention, a part of the inside of the cavity is matched with the external shape of the basket. It is not necessary to match the shape of the whole inside of the cavity with the external shape of the basket. When the shape of only a part of the inside of the cavity is matched with the external shape of the basket, it is also possible to obtain the same operation and effects as those of the cask of the above-mentioned invention.

In other words, when the shape of a part of the inside of the cavity is matched with the external shape of the basket, it is possible to secure a contact area between the inner surface of the cavity and the angular pipes, and at the same time, it is possible to make smaller the space area within the cavity. Therefore, it is possible to efficiently carry out a thermal conduction. Further, it is possible to make smaller the external diameter of the shell main body by the portion of the space area that has been reduced. On the other hand, when the external diameter of the shell main body is left as it is, it becomes possible to increase the number of accommodating the used nuclear fuel aggregates.

According to the cask of next invention, the shape of either one of the inner surface of a cavity of a shell main body that has a neutron shielding unit at its outer periphery and shields the γ-rays or the outer surface of a basket that has latticed cells structured by a plurality of angular pipes having neutron absorbing property, is matched with the shape of the other, whereby each used nuclear fuel aggregate is accommodated in each cell of the basket inserted into the cavity.

The used nuclear fuel aggregates accommodated within the cells of the basket have a radiation and decay heat, and this decay heat reaches the outer surface of the basket through the cells. As the outer surface of the basket and the inner surface of the cavity are in contact with each other by matching the shape of one of these surfaces with the shape of the other, the decay heat is efficiently conducted from the basket to the shell main body, and is radiated to the outside. When the shape of the inner surface of the cavity is matched with the shape of the outer surface of the basket, there is no space area inside the cavity. Therefore, it is possible to make smaller the external diameter of the shell main body. On the other hand, when the shape of the outer surface of the basket is matched with the shape of the inner surface of the cavity, it becomes possible to insert more angular pipes.

In this case, in matching the shape of one of the outer surface of the basket and the inner surface of the cavity with the shape of the other, for example, the shape of the inner surface of the cavity may be matched with the shape of the outer surface of the basket, thereby plane processing the inner surface of the cavity. Alternatively, the shape of the outer surface of the basket may be matched with the shape of the inner surface of the cavity, thereby shaping the cells of the outer periphery. The above contact state does not necessarily mean that the inner surface of the cavity and the outer surface of the basket are always in complete contact with each other, but that this contact state also includes a state that there is a slight gap or the contact is temporarily cancelled.

According to the cask of next invention, in the cask of the above-mentioned invention, dummy pipes are further provided, and the shape of a portion within the cavity that has room in the thickness of the shell main body is matched with the shape of the dummy pipes, whereby the dummy pipes are inserted into the cavity together with the basket in a state that the dummy pipes are in contact with the angular pipes.

When the shape of the inside of the cask is matched with the external shape of the basket, the thickness of the shell main body becomes inhomogeneous. However, when the shell main body has secured a predetermined thickness for shielding the γ-rays, the other additional thickness portion becomes a cause of increasing the weight of the cask. Therefore, in the cask of this aspect, the shape of a portion within the cavity that has room in the thickness is matched with the shape of the dummy pipes, and the dummy pipes are inserted into this portion, thereby reducing the weight of the cask.

Further, as the dummy pipes are inserted into the cavity in a state that they are brought into contact with the angular pipes, the dummy pipes work as a medium for conducting heat from the angular pipes to the shell main body, and also have a function of pressing the angular pipes together to keep them in contact with each other. Based on this arrangement, it becomes possible to improve the thermal conductivity between the angular pipes. Further, the shape and the number of dummy pipes are suitably selected as necessary. The state of keeping the dummy pipes in contact with the angular pipes means that they are not necessarily always in complete contact with each other, as is the case with the above aspect.

According to the cask of next invention, in the cask of the above-mentioned invention, auxiliary shielding units for shielding the γ-rays are further provided at portions of the outermost side of the shell main body that has a small thickness of the shell main body.

When the shape of the inside of the cavity is matched with the external shape of the basket, for example, the thickness of the shell main body becomes small at a corner portion of the basket. Therefore, the γ-rays shielding capacity is lowered at this portion. Thus, the auxiliary shielding unit is provided at this portion, thereby increasing the γ-rays shielding capacity. In providing the auxiliary shielding unit at the outside of the shell main body, the auxiliary shielding unit may be provided at a position where the auxiliary shielding unit is in contact with the outer surface of the shell main body. Alternatively, the auxiliary shielding unit may be embedded into the neutron shielding unit with a slight distance from the outer surface of the shell main body. The material of the auxiliary shielding unit maybe the same as that of the shell main body, or may be different from the material of the shell main body so long as the material has a the γ-rays shielding capacity.

According to the cask of next invention, spacers are provided between a cavity of a shell main body that has a neutron shielding unit at its outer periphery and shields the γ-rays and a basket that has latticed cells structured by a plurality of angular pipes halving neutron absorbing property, whereby each used nuclear fuel aggregate is accommodated in each cell of the basket inserted into the cavity.

When the basket is inserted into the shell main body, having the cavity of a cylindrical shape (see FIG. 19), the basket and the cavity are brought into a line contact with each other. Further, a space area is generated inside the cavity. Therefore, the decay heat of the used nuclear fuel aggregates is not easily conducted from the cells to the shell main body. Thus, in this aspect, spacers are inserted into between the cavity and the basket, thereby eliminating the space area and increasing a substantive contact area. Heat is conducted through these spacers.

For these spacers, it is possible to use spacers of the same material as that of the shell main body and having a semicylindrical cross section, or spacers of the same material as that of the cells and having hollow-shaped cross section formed by extrusion or pressing. Further, spacers may be provided in all spaces between the cavity and the basket, or spacers may be provided at only necessary portions. Based on the above structure, the thermal conductivity from the cells to the shell main body is improved.

According to the cask of next invention, in the cask of the above-mentioned invention, a plurality of angular pipes that constitute the basket are integrated together before they are inserted into the cavity. When each one angular pipe is inserted into the cavity, the cask assembly, work becomes troublesome, and a contact interface between the angular pipes interferes with the improvement in thermal conductivity. Thus, a plurality of angular pipes that constitute the basket are integrated together. With this arrangement, it becomes possible to collectively insert the angular pipes into the cavity, which simplifies the assembling work. As no contact interface exists, the thermal conductivity is improved further.

The cask according to the next invention comprises a basket having a plurality of latticed cells formed for accommodating used nuclear fuel aggregates, by bundling a plurality of angular pipes having a neutron absorbing material added to a structural material; a shell main body having a cylindrical cavity that has been forged from a γ-rays shielding material, and that is plane processed by matching the shape of the inside of this cavity with the external shape of the basket constructed of the angular pipes; and a neutron shielding unit having a plurality of internal fins extended between the shell main body and an external cylinder, and for shielding neutrons filled in a space formed by the shell main body, the external cylinder and the internal fins, whereby the angular pipe are sequentially inserted into the cavity to structure the basket while bringing the outer surface of the basket into contact with the inner surface of the cavity.

A radiation and decay heat are generated from the used nuclear fuel aggregates that are accommodated in cells. This decay heat reaches the outer surface of the basket through cells adjacent to the corresponding cells. The inside of the cask is plane processed to match the external shape of the basket, and the outer surface of the basket is in contact with the inner surface of the cavity. Therefore, the decay heat is efficiently conducted to the shell main body. The decay heat that has been conducted to the shell main body is radiated from the external cylinder mainly through the internal fins. On the other hand, the neutron that has been generated from the used nuclear fuel aggregates is absorbed by the neutron absorbing material, such as boron, for example, that has been added to the pipes. Thus, the neutron is prevented from reaching the criticality. The γ-rays is shielded by the shell main body, and the neutron is shielded by the neutron shielding unit.

Further, by bringing the outer surface of the basket into contact with the inner surface of the cavity, it is possible to avoid the space area as shown in FIG. 19. Therefore, it is possible to make smaller the external diameter of the shell main body. On the other hand, when the external shape of the shell main body is made the same as that shown in FIG. 19, it becomes possible to insert more angular pipes into the cavity.

The cask according to the next invention has the shape of the inside of a cavity of a shell main body that has a neutron shielding unit at its outer periphery and shields the γ-rays is matched with the external shape of a basket that has a latticed angular cross-sectional shape by alternately combining in an orthogonal direction a plurality of plates having neutron absorbing property, whereby each used nuclear fuel aggregate is accommodated in each cell of the basket inserted into the cavity.

Further, in a similar manner to that explained above, it is possible to avoid the space area and, therefore, it is possible to make smaller the external diameter of the shell main body. On the other hand, when the external diameter of the shell main body is made the same as that shown in FIG. 19, it becomes possible to insert more angular pipes into the cavity. As the angular pipes have the neutron absorbing property, the angular pipes do not reach the criticality when the angular pipes have accommodated the used nuclear fuel aggregates.

According to the cask of next invention, in the cask of the above-mentioned invention, a part of the inside of the cavity is matched with the external shape of the basket. It is not necessary to match the shape of the whole inside of the cavity with the external shape of the basket. When the shape of only a part of the inside of the cavity is matched with the external shape of the basket, it is also possible to obtain the same operation and effects as those of the cask of the ninth aspect.

According to the cask of next invention, in the cask of the above-mentioned invention, dummy pipes are further provided, and the shape of a portion within the cavity that has room in the thickness of the shell main body is matched with the shape of the dummy pipes, whereby the dummy pipes are inserted into the cavity together with the basket in a state that the dummy pipes are in contact with the plates.

Further, as the dummy pipes are inserted into the cavity in a state that they are brought into contact with the plates, the dummy pipes work as a medium for conducting heat from the basket to the shell main body. Based on this arrangement, it becomes possible to improve the thermal conductivity from the basket to the shell main body. The state of keeping the dummy pipes in contact with the plates means that they are not necessarily always in complete contact with each other, as is the case with the above aspect.

According to the cask of next invention, in the cask of the above-mentioned invention, when the basket is constructed by combining the plates, a thermal conductive plate having a contact with the cavity wall is provided at the end of each plate positioned at the outer periphery of the basket.

According to the cask of next invention, in the cask of the above-mentioned invention, when the basket is constructed by combining the plates, a thermal conductive plate is provided between the end of each plate positioned at the outer periphery of the basket and the end of the other plate.

Based on the provision of a thermal conductive plate between the ends of the plates, the thermal conductive plates are brought into a plane contact with the internal surface of the cavity of the shell main body. Therefore, it becomes possible to improve the thermal conductivity from the plates to the shell main body.

BEST MODE FOR CARRYING OUT THE INVENTION

A cask relating to the present invention will be explained in detail below with reference to the drawings. It should be noted that the present invention is not limited to the following embodiments.

Figure 1:
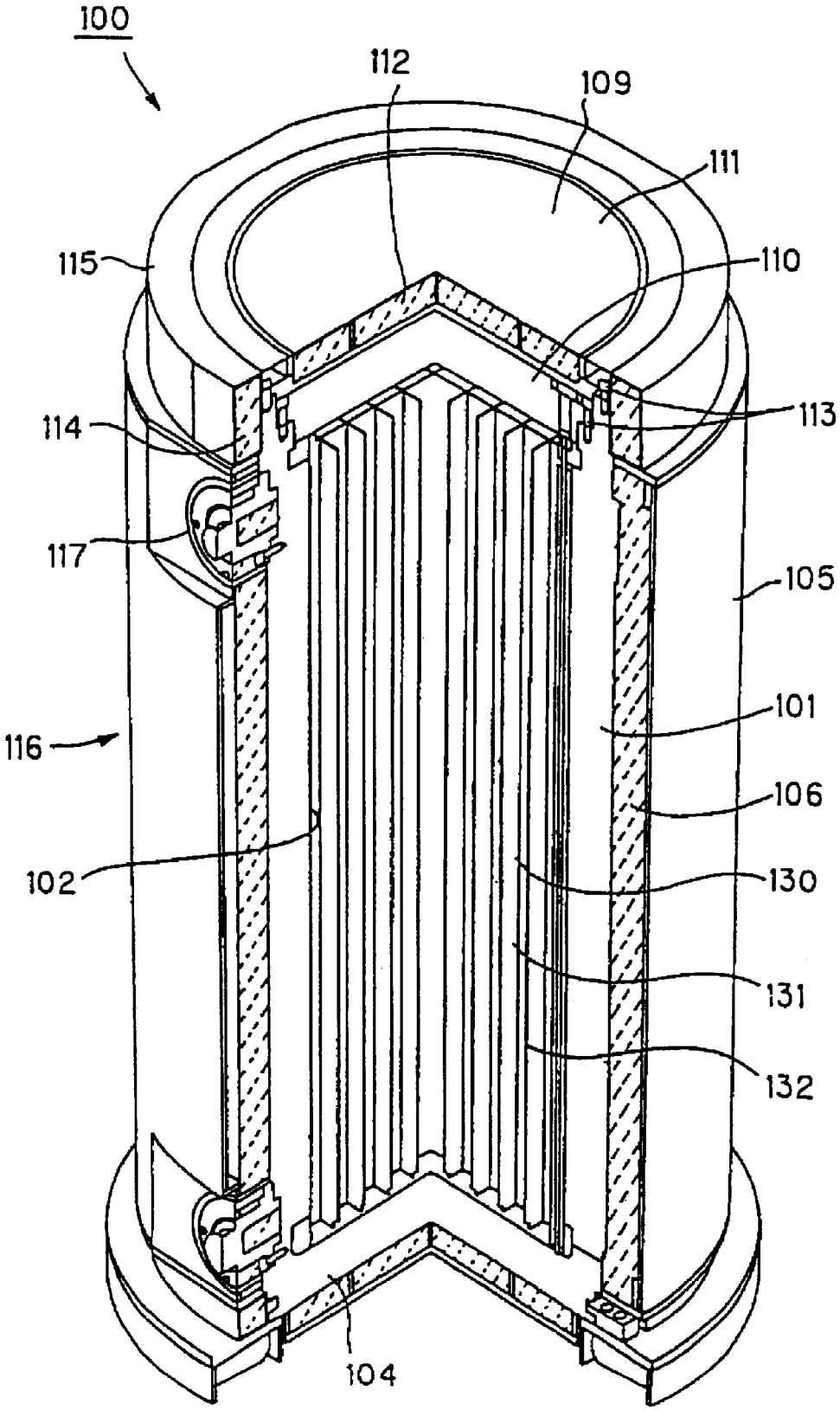
FIG. 1 is a perspective view showing a cask relating to a first embodiment of the present invention.
Figure 2:
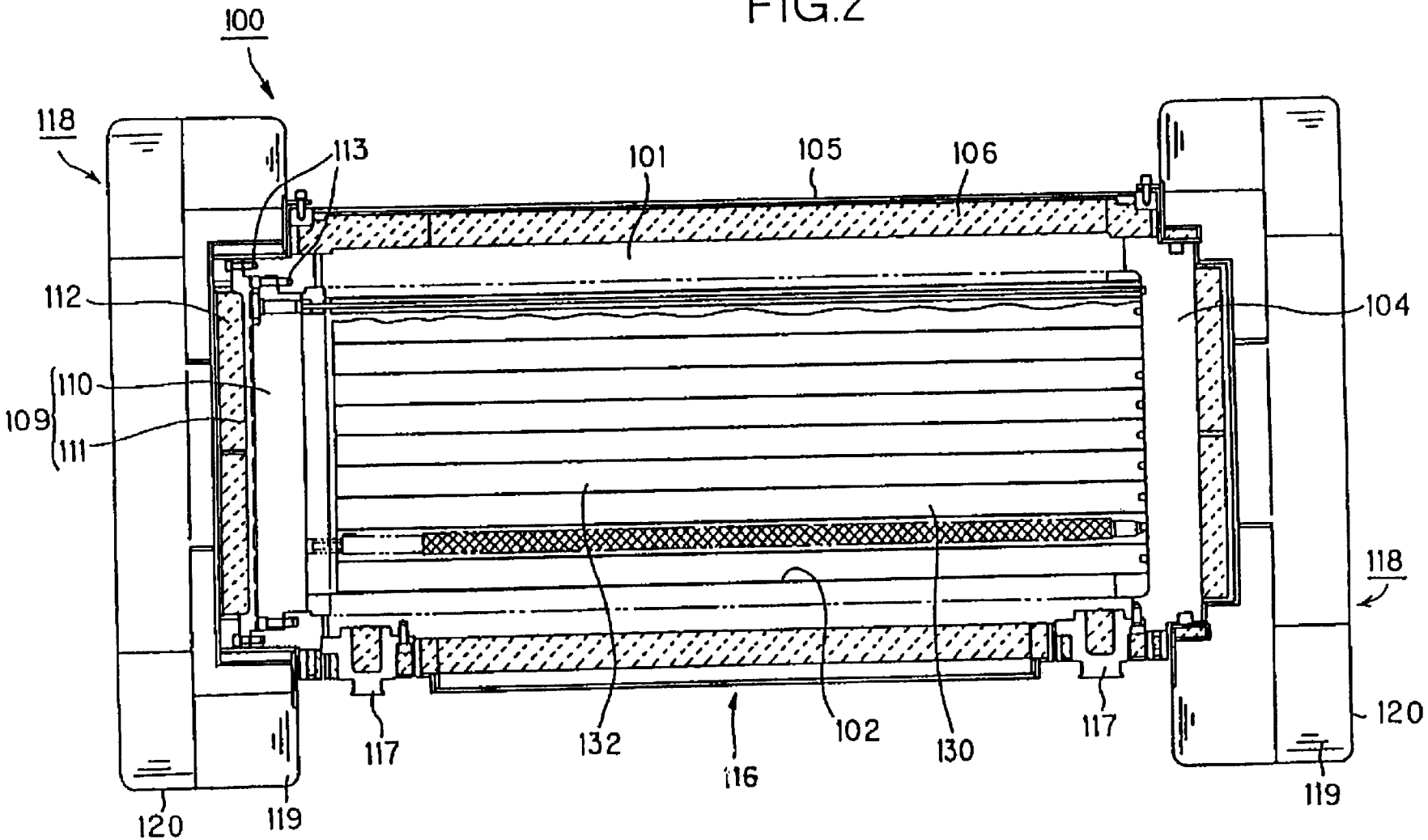
FIG. 2 is a cross-sectional view of the cask cut along a radial direction of the cask shown in FIG. 1.
Figure 3:
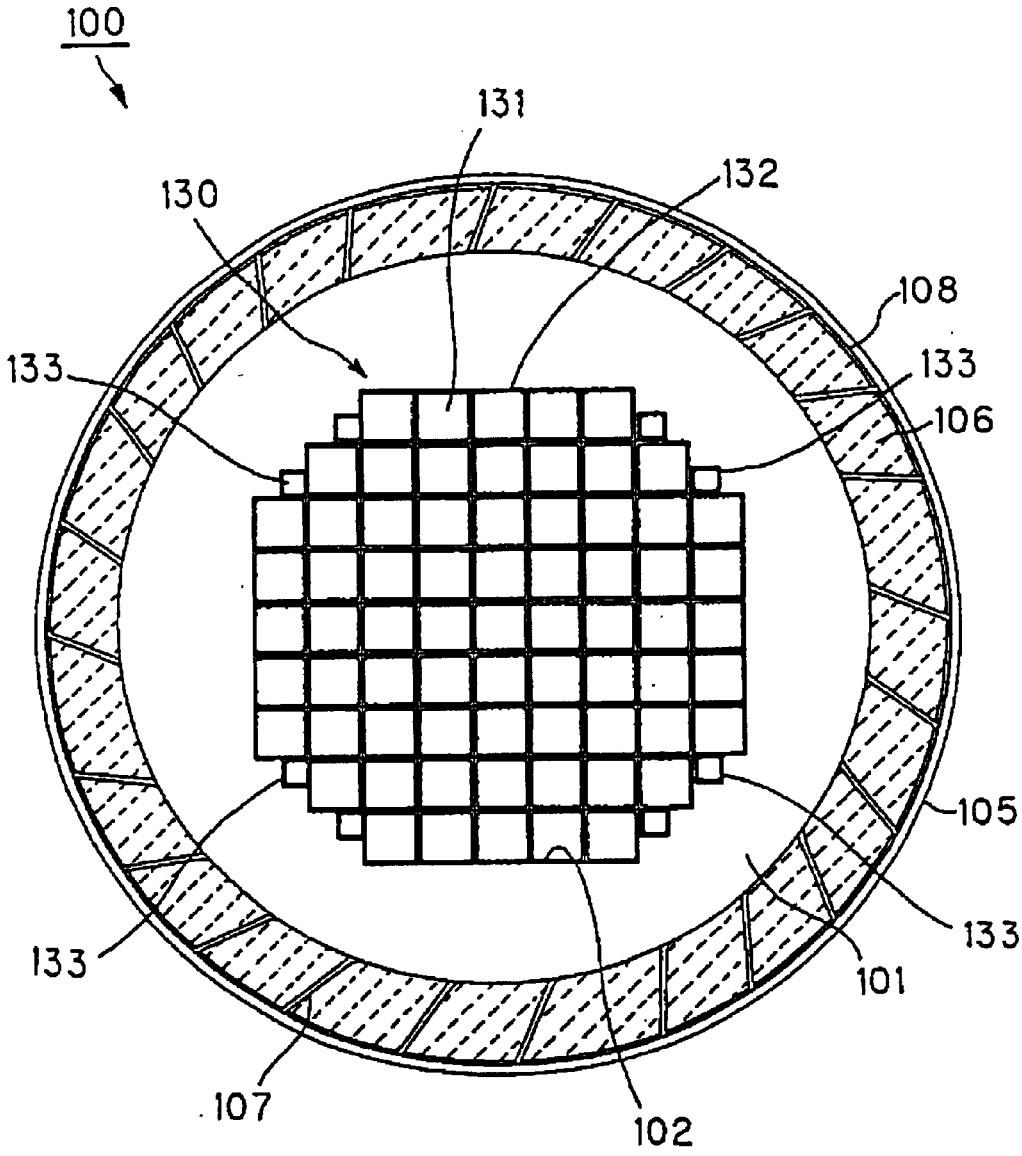
FIG. 3 is a cross-sectional view of the cask cut along an axial direction of the cask shown in FIG. 1.

FIG. 1 is a perspective view showing a cask relating to a first embodiment of the present invention. FIG. 2 is a cross-sectional view of the cask cut along a radial direction of the cask shown in FIG. 1. FIG. 3 is a cross-sectional view of the cask cut along an axial direction of the cask shown in FIG. 1. A cask 100 relating to the first embodiment is provided by mechanically processing the inner surface of a cavity 102 of a shell main body 101 to match the shape of the inner surface of the cavity with the shape of the outer periphery of a basket 130. The mechanical processing of the inner surface of the cavity 102 is carried out by milling the cavity 102 with an exclusive processing apparatus to be described later. A shell main body 101 and a bottom plate 104 have been forged from carbon steel having a γ-rays shielding function. A stainless steel may also be used instead of the carbon steel. The shell main body and the bottom plate 104 are connected together by welding. Further, in order to secure a sealing function of a pressure-resistant vessel, a metal gasket is provided between a primary lid 110 and the shell main body 101.

A resin 106 that is a high polymer material including much hydrogen and having neutron shielding function is filled between the shell main body 101 and an external cylinder 105. Further, a plurality of copper internal fins 107 for carrying out a thermal conduction is welded between the shell main body 101 and the external cylinder 105. The resin 106 is injected in a fluid state into spaces formed by the internal fins 107, and is cooled and solidified afterward. It is preferable that the internal fins 107 are provided in a high density at a portion where there is much heat quantity, in order to homogenize the heat radiation. A thermal expansion margin 108 of a few mm is provided between the resin 106 and the external cylinder 105. This thermal expansion margin 108 is formed in the following process. First, a vanish type having a heater embedded into a hot melt adhesive or the like is disposed on the inner surface of the external cylinder 105, then the resin 106 is injected into this and solidified, and the heater is heated to melt the adhesive to flow it out thereby forming the margin (not shown).

A lid section 109 is constructed of the primary lid 110 and a secondary lid 111. This primary lid 110 is made of stainless steel or carbon steel having a γ-rays shielding function, and is formed in a disk shape. The secondary lid 111 is also made of stainless steel or carbon steel, and is formed in a disk shape. On the upper surface of the secondary lid 111, a resin 112 is sealed as a neutron shielding unit. A metal gasket is provided between the primary lid 110 and the secondary lid 111, and between the secondary lid 111 and the shell main body 101, respectively, thereby holding the internal sealing. An auxiliary shielding unit 115 having a resin 114 sealed therein is provided around the lid section 109.

On both sides of a cask main body 116, trunnions 117 are provided for suspending the cask 100. While FIG. 1 shows a state that the auxiliary shielding unit 115 has been installed, this auxiliary shielding unit 115 is taken out and buffer units 118 are installed on the cask 100 at the time of carrying the cask 100 (see FIG. 2). The buffer units 118 have a structure that a buffering material such as a read wood material 119 has been built into an external cylinder 120 that is prepared by a stainless steel material. The basket 130 is constructed of 69 angular pipes 132 that structure cells 131 for accommodating used nuclear fuel aggregates. For the angular pipes 132, there are used an aluminum composite or an aluminum alloy that is prepared by adding a powder of boron or a boron compound having neutron absorbing property to a powder of Al or an Al alloy. Instead of boron, cadmium may also be used for the neutron absorbing material.

Figure 4:
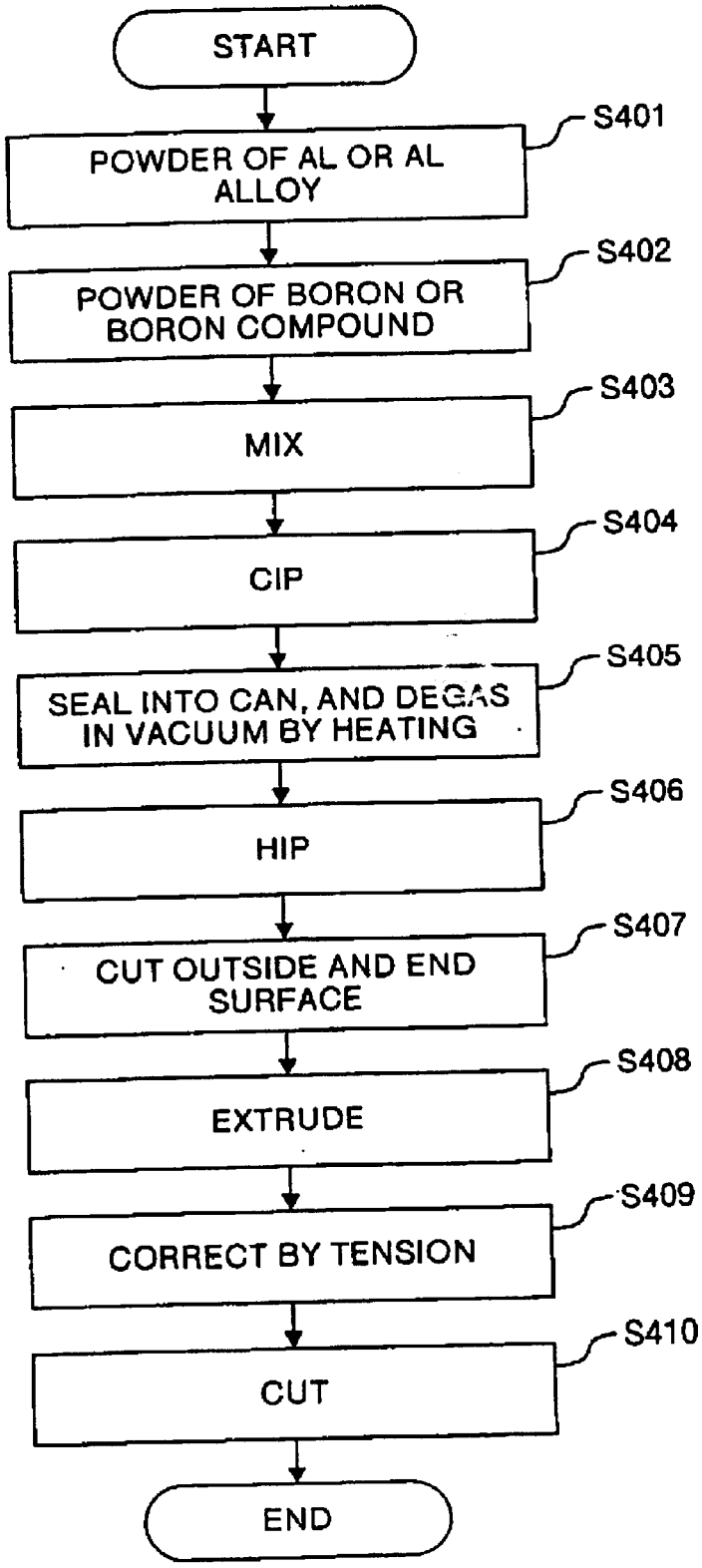
FIG. 4 is a flowchart showing a method of manufacturing an angular pipe.
Figure 5:
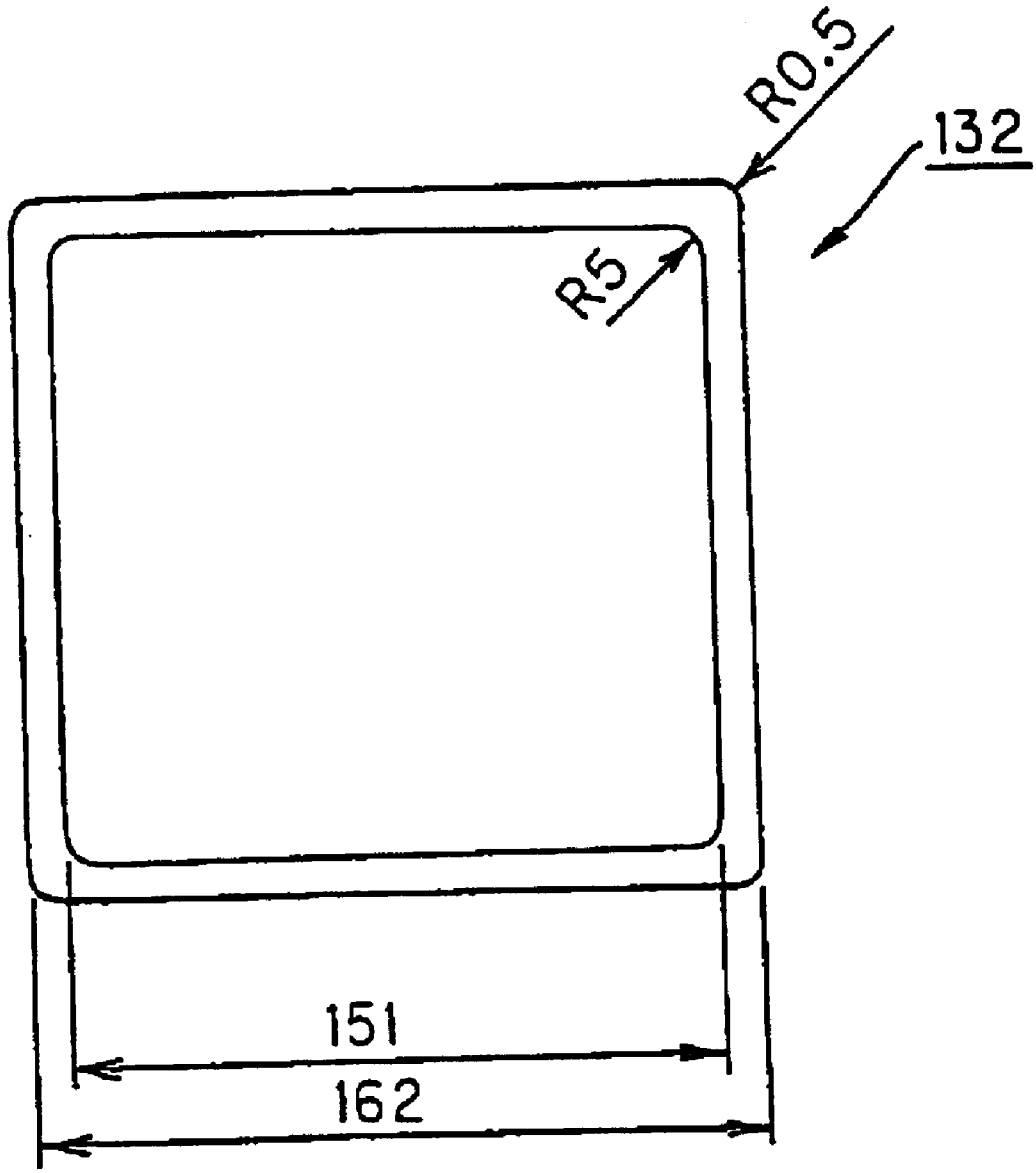
FIG. 5 is an explanatory view showing a state of a cross-section of the angular pipe.

FIG. 4 is a flowchart showing a method of manufacturing the angular pipe. First, a powder of Al or an Al alloy is prepared based on a rapid cooling solidification method such as an atomizing method (step S401). Then, a powder of boron or a boron compound is prepared (step S402). Both particles are mixed together for 10 to 15 minutes with a cross rotary mixer or the like (step S403).

For the above aluminum or aluminum alloy, there may be used any one of pure aluminum metal, Al—Cu aluminum alloy, Al—Mg aluminum alloy, Al—Mg—Si aluminum alloy, Al—Zn—Mg aluminum alloy, and Al—Fe aluminum alloy. For the boron or boron compound, there may be used $B_4C$, or $B_2O_3$. It is preferable that the volume of boron to be added to aluminum is within the range of not less than 1.5 weight % and not more than 7 weight %. When the volume is less than 1.5 weight %, it is not possible to obtain a sufficient neutron absorbing property, and when the volume is larger than 7 weight %, a stretch at the time of tension is lowered.

Next, the mixed powder is sealed into a rubber case, and is applied with homogeneous pressure by CIP (Cold Isostatic Press) from all directions at a normal temperature, thereby carrying out a powder molding (step S404). The CIP molding is carried out under a condition that the molding pressure is 200 MPa, the diameter of a molded product is 600 mm, and the length of the molded product is 1,500 mm. Based on the application of homogeneous pressure from all directions by the CIP, it becomes possible to obtain a molded product of high density with small variation in the density of the molded product.

Next, the powder molded product is sealed into a can in vacuum, and this is heated to 300° C. (step S405). In this degassing process, the gas component and water component within the can is removed. At the next step, the vacuum degassed molded product is remolded by HIP (Hot Isostatic Press) (step S406). The HIP molding is carried out under a condition that the molding temperature is within a range from 400° C. to 450° C., the molding time is 30 seconds, the molding pressure is 6,000 tons, and the diameter of the molded product is 400 mm. Then, in order to remove the can, the outside and the end surfaces are cut (step S407), and the billet is hot extruded by using a porthole extruder (step S408). The extrusion is carried out under a condition that the heating temperature is within a range from 500° C. to 520° C., and the extrusion speed is 5 m/min. This condition is suitably changed based on the weight of boron included in the billet.

After the extrusion molding, the shape of the billet is corrected by tension (step S409), and a non-steady portion and an evaluation portion are cut out, thereby providing a finished product as an angular pipe (step S410). The completed angular pipe has a square shape with 162 mm for one side of a cross section, and 151 mm for an internal side. A minus tolerance Of dimension is 0 because of the required standard. The R of an inside angle is set to 5 mm, and the R of an outside R is set to 0.5 mm to have a sharp edge.

When the R of the edge portion is taken large, a stress applied to the basket 130 is concentrated to a specific portion (near the edge) of the angular pipe 132, which becomes a cause of damaging the basket. Therefore, by providing the angular pipe 132 with a sharp edge, a stress applied to this angular pipe is transferred straight to the adjacent angular pipe 132, which makes it possible to avoid a concentration of the stress to a specific portion of the angular pipe 132. As another method of manufacturing the angular pipe 132, the present applicant has already filed an application "Basket and Cask" on May 27, 1999. Therefore, the angular pipes may be manufactured by referring to this method.

Figure 6:
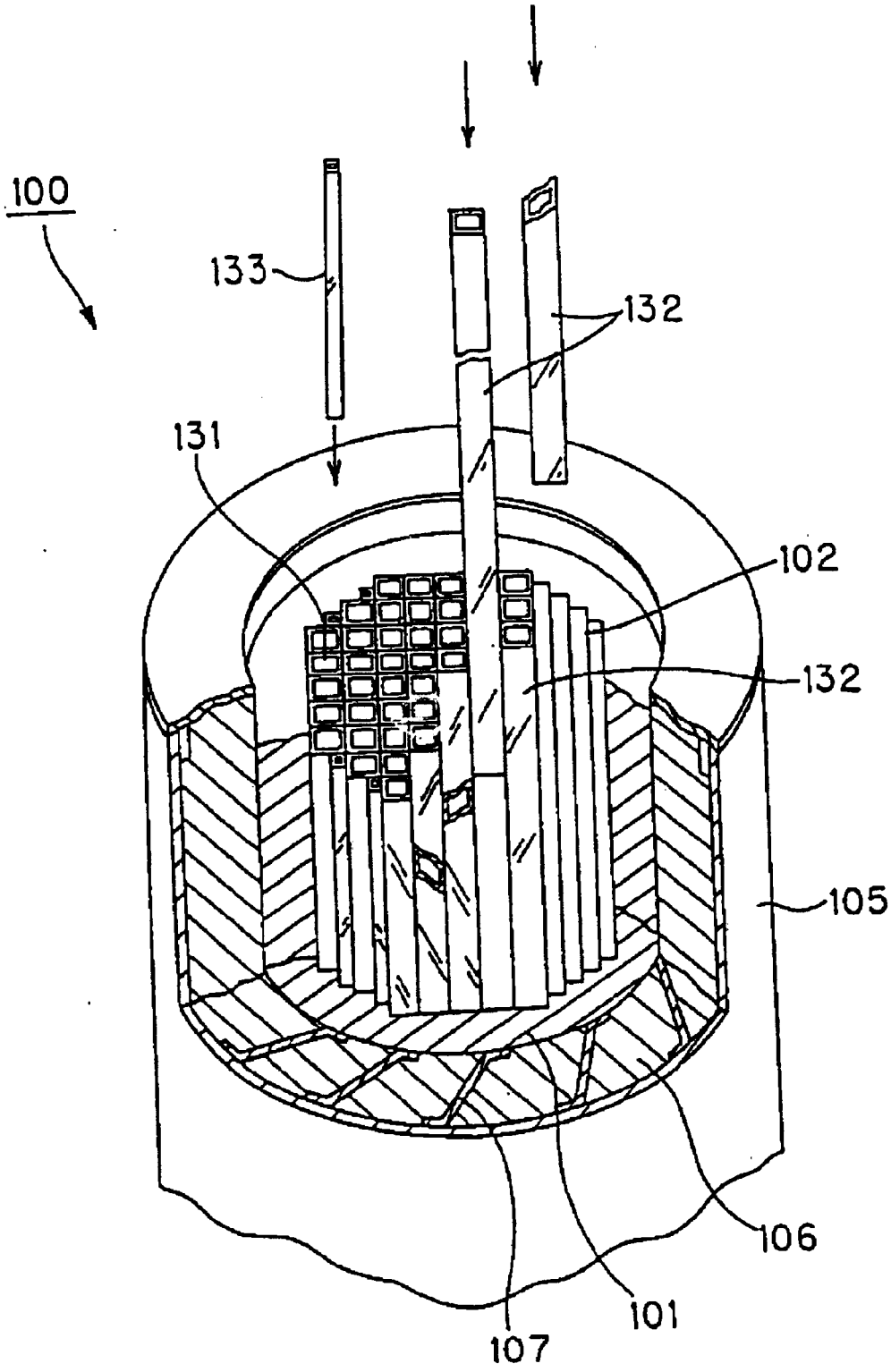
FIG. 6 is a perspective view showing a method of inserting the angular pipes.

FIG. 6 is a perspective view showing a method of inserting the angular pipes. The angular pipes 132 manufactured in the above process are sequentially inserted into one cavity 102 along a processing shape within the cavity 102. As each angular pipe 132 has a bending and a twist and also as the minus tolerance of dimension is 0, the angular pipes 132 cannot be easily inserted into the cavity 102 because of the influence of the accumulation of the tolerance and the bending. When an attempt is made to compulsively insert the angular pipes 132 into the cavity 102, an excessive stress is applied to the angular pipes 132. To avoid this problem, the bending and the twist of the whole or a part of the angular pipe 132 manufactured are measured in advance with a laser measuring apparatus. Then, an optimum position of insertion is calculated based on the measured data by using a computer. With this arrangement, it becomes easy to insert the angular pipes 132 into the cavity 102, and it becomes possible to homogenize the stress applied to the angular pipes 132.

Further, as shown in FIG. 6 and FIG. 2, dummy pipes 133 are inserted on both sides of each row of angular pipe that has five or seven cells within the cavity 102. These dummy pipes 133 have objects of reducing the weight of the shell main body 101, homogenizing the thickness of the shell main body 101, and securely fixing the angular pipes 132. An aluminum alloy including boron is also used for these dummy pipes 133, and these dummy pipes 133 are manufactured in a process similar to that described above. These dummy pipes 133 can also be omitted.

Figure 7:
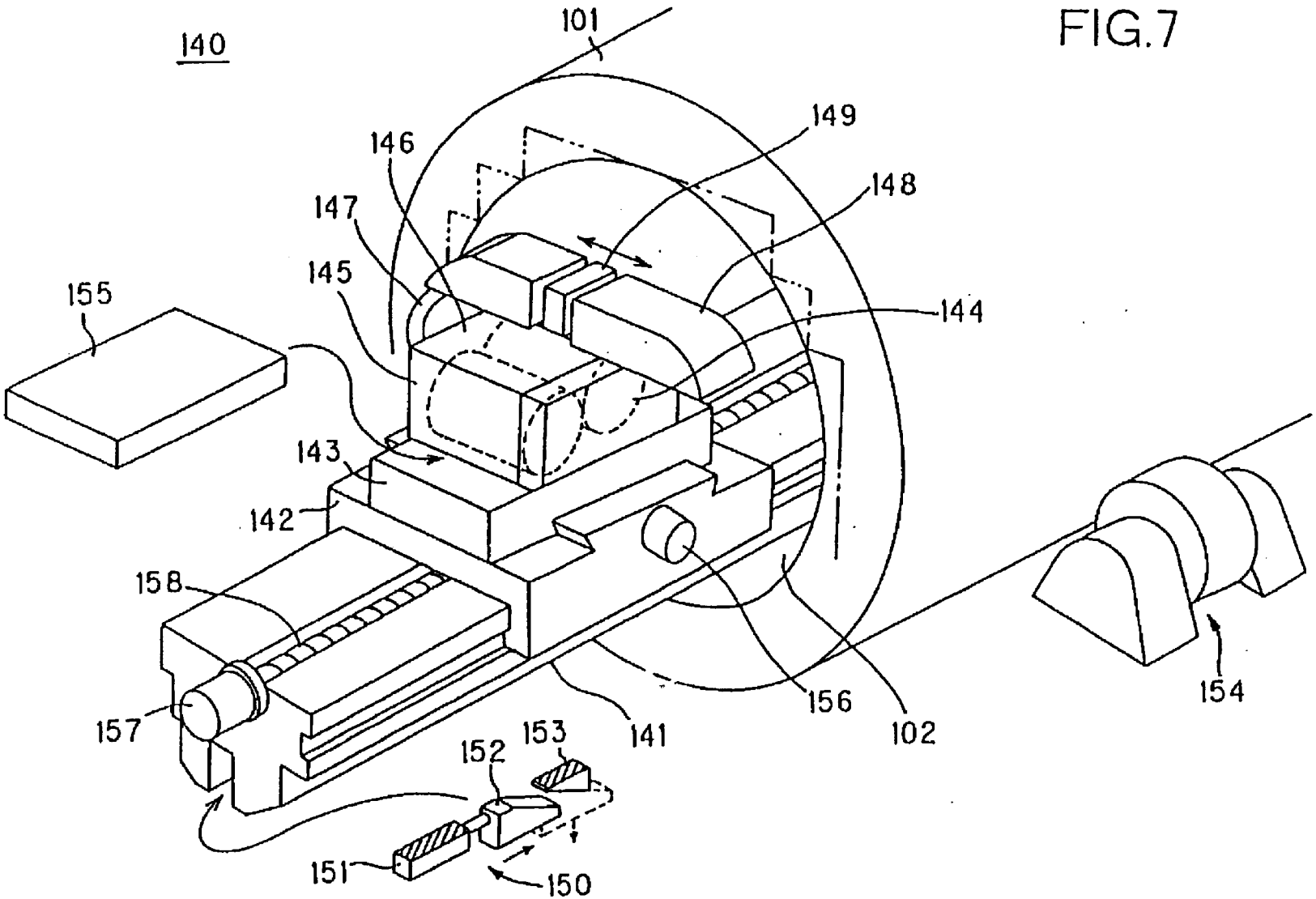
FIG. 7 is a schematic perspective view showing an apparatus for processing a cavity.

The processing of the cavity 102 within the shell main body 101 will be explained next. FIG. 7 is a schematic perspective view showing an apparatus for processing the cavity 102. This processing apparatus 140 is constructed of a fixed table 141 that pierces through the shell main body 101 and that is fixedly mounted within the cavity 102, a movable table 142 that slides on the fixed table 141 in an axial direction, a saddle 143 that is fixedly positioned on the movable table 142, a spindle unit 146 that is provided on the saddle 143 and is constructed of a spindle 144 and a driving motor 145, and a face mill 147 provided on the spindle axis. A reaction force receiver 148 having a contacting section according to the inner shape of the cavity 102 is provided on the spindle unit 146. This reaction force receiver 148 is detachable and slides in an arrow direction shown along a dovetail groove (not shown). The reaction force receiver 148 has a clamping unit 149 for clamping the spindle unit 146, and can be fixed at a predetermined position.

A plurality of clamping units 150 is fitted to within a groove at a lower part of the fixed table 141. Each clamping unit 150 is constructed of a hydraulic cylinder 151, a wedge-shaped moving block 152 provided on the axis of the hydraulic cylinder 151, and a fixed block 153 that is in contact with the moving block 152 on a sloped surface. A shaded side shown in the drawing is fitted to the inner surface of the groove formed on the fixed table 141. When the axis of the hydraulic cylinder 151 is driven, the moving block 152 is brought into contact with the fixed block 153, and the moving block 152 slightly moves downward due to the wedge effect (shown by a dotted line in the drawing) As the lower surface of the moving block 152 is pushed against the inner surface of the cavity 102, the fixed table 141 can be fixed within the cavity 102.

The shell main body 101 is mounted on a rotation supporting base 154 made of a roller, and is rotatable in a radial direction. A spacer 155 is inserted into between the spindle unit 146 and the saddle 143, thereby making it possible to adjust the height of the face mill 147 on the fixed table 141. The thickness of the spacer 155 is the same as the size of one side of the angular pipe 132. The saddle 143 moves in a radial direction of the shell main body 101 when a handle 156 provided on the moving table 142 is rotated. The move of the moving table 142 is controlled by a servomotor 157 provided at an end of the fixed table 141 and a ball screw 158. As the processing proceeds, the shape within the cavity 102 changes. Therefore, it is necessary to change the reaction force receiver 148 and the moving block 152 of the clamping mechanism with appropriate ones respectively.

Figure 8:
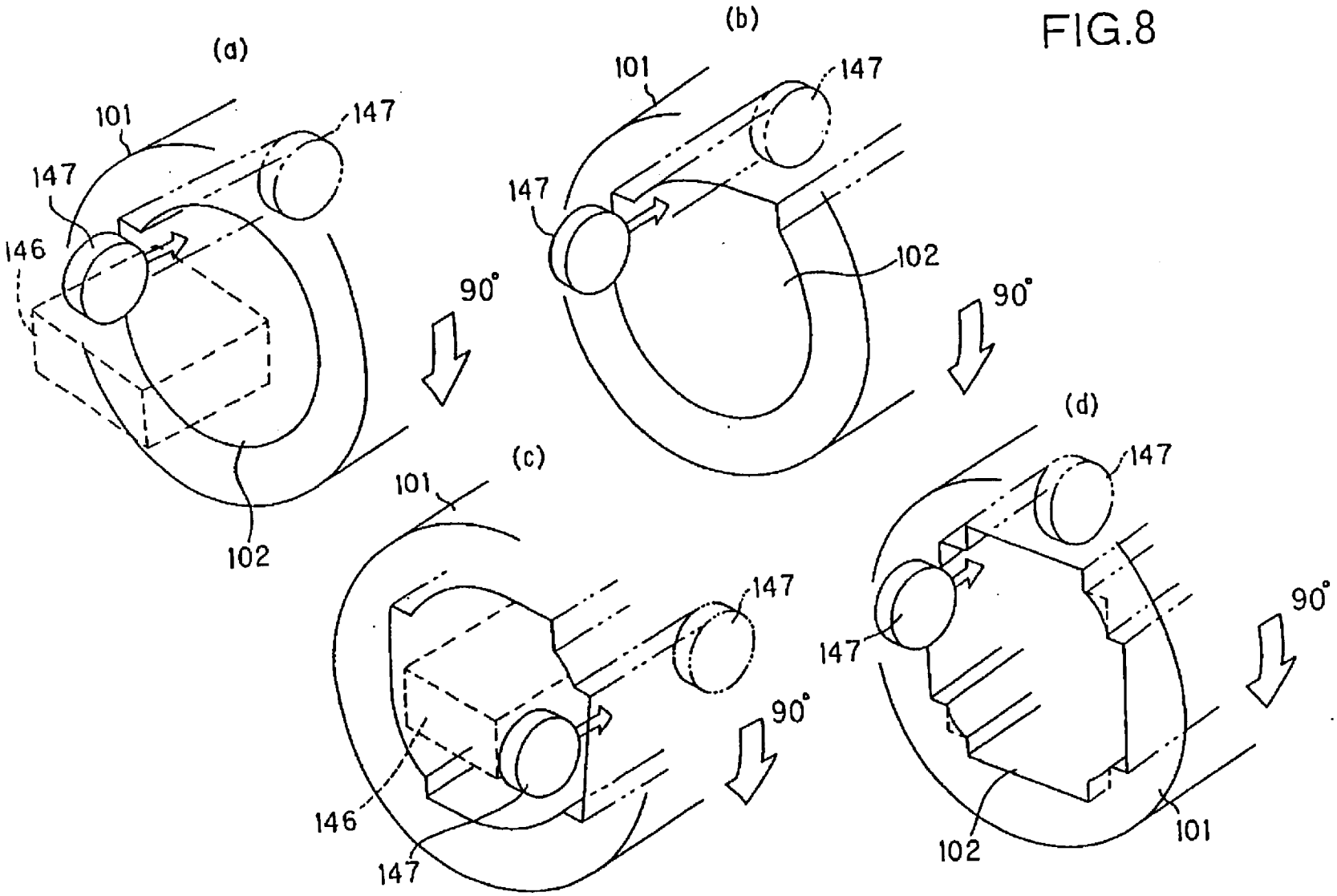
FIG. 8 shows schematic perspective views for explaining a method of processing the cavity.

FIG. 8 shows schematic perspective views for explaining a method of processing the cavity. First, the fixed table 141 is fixed at a predetermined position within the cavity 102 by the clamping unit 150 and the reaction force receiver 148. Next, as shown in FIG. 8(*a*), the spindle unit 146 is moved at a predetermined cutting speed along the fixed table 141, thereby making the face mill 147 cut the inner surface of the cavity 102. When the cutting at this position has been finished, the clamping unit 150 is removed and the fixing table 141 is released. Next, as shown in FIG. 8(*b*), the shell main body 101 is rotated by 90 degrees on the rotation supporting table 154, and the fixed table 141 is fixed with the clamping unit 150. Then, the inner surface of the cavity 102 is cut with the face mill 147 in a similar manner. Thereafter, a similar process is repeated by two times.

Next, the spindle unit 146 is rotated by 180 degrees, and the inner surface of the cavity 102 is cut sequentially as shown in FIG. 8(*c*). In this case, the shell main body 101 is also rotated by 90 degrees, and the above processing is repeated. Next, as shown in FIG. 8(*d*), the spacer 155 is inserted into between the spindle unit 146 and the saddle 143, thereby increasing the height of the spindle unit. At this position, the face mill 147 is fed in an axial direction to cut the inner surface of the cavity 102. This is repeated while rotating the shell main body 101 by 90 degrees. Thus, an inner shape of the spindle necessary for inserting the angular pipes 132 is substantially completed. The cutting of the portion where the dummy pipes 133 are inserted is also carried out in a similar manner to that shown in FIG. 8(*d*). However, the thickness of the spacer for adjusting the height of the spindle unit 146 is the same as the size of one side of the dummy pipe 133.

The used nuclear fuel aggregates that are accommodated in the cask 100 include a nuclear fission material and a fission product, and thus generate a radiation and involve decay heat. Therefore, it is necessary to securely maintain the heat-removing function, the shielding function and the criticality preventing function of the cask 100 during the storage period (approximately 60 years) respectively. According to the cask 100 relating to the first embodiment of the present invention, the inner surface of the cavity 102 of the shell main body 101 is mechanically processed to accommodate the angular pipes 132 inside the cavity, in a state that the outside of the basket 130 is sealed (not space area). Further, the internal fins 107 are provided between the shell main body 101 and the external cylinder 105. Therefore, the heat from the fuel bar is conducted to the shell main body 101 through the angular pipes 132 or the filled helium gas, and is radiated from the external cylinder 105 mainly through the internal fins 107. Based on the above structure, the thermal conductivity of the heat from the angular pipes 132 is improved, and it becomes possible to efficiently remove the decay heat.

Further, the γ-rays generated from the used nuclear fuel aggregates is shielded by the shell main body 101, the external cylinder 105 and the lid section 109 made of carbon steel or stainless steel respectively. The neutron is shielded by the resin 106 to avoid an influence of exposure to a person engaged in the radiation business. Specifically, the resin 106 is designed to be able to obtain a shielding function so that the surface dose equivalent rate becomes not higher than 2 mSv/h and the dose equivalent rate at 1 m height from the surface is not higher than 100 μSv/h. Further, as an aluminum alloy including boron is used for the angular pipes 132 that constitute the cells 131, it is possible to absorb neutron and to prevent the neutron from reaching the criticality.

Figure 19:
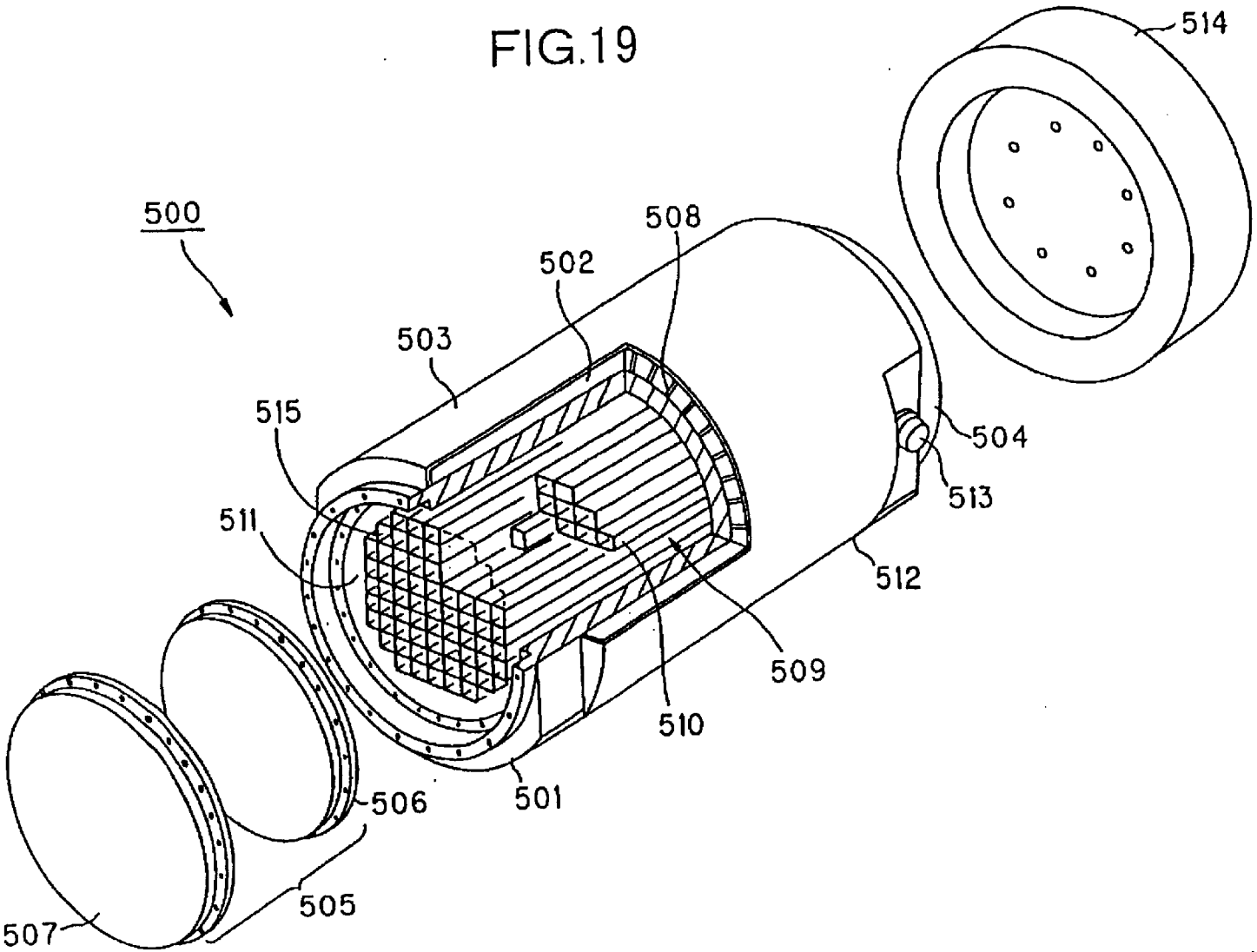
FIG. 19 is a perspective view showing one example of a cask.
Figure 20:
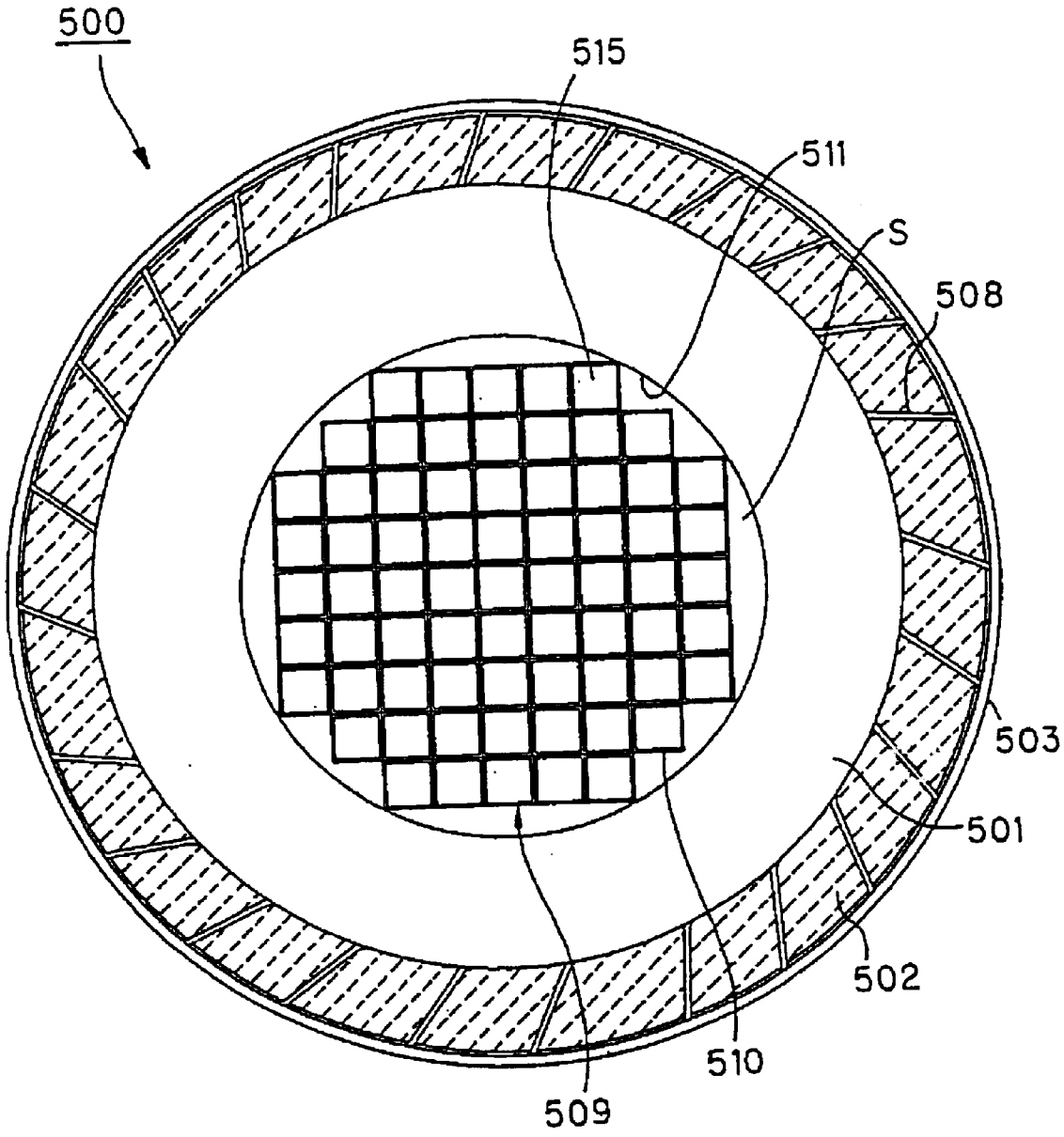
FIG. 20 is a cross-sectional view of the cask cut along an axial direction of the cask shown in FIG. 19.

As explained above, according to the cask 100 relating to the first embodiment of the present invention, the inside of the cavity 102 of the shell main body 101 is mechanically processed, and the angular pipes 132 that structure the outer periphery of the basket 130 are inserted into the cavity in a closely adhered state. Therefore, it is possible to improve the thermal conductivity of the heat from the angular pipes 132. Further, as the space area inside the cavity 102 can be eliminated, it is possible to make the shell main body 101 in compact and with reduced weight. Even in this case, the number of the angular pipes 132 that can be accommodated is not reduced. On the contrary, when the external diameter of the shell main body 101 is made the same as that of the cask shown in FIG. 19, it becomes possible to secure the number of cells by that amount, and it is possible to increase the number of used nuclear fuel aggregates that can be accommodated. Specifically, the cask 100 can accommodate 69 used nuclear fuel aggregates, and it is also possible to restrict the external diameter of the cask main body 116 to 2,560 mm and its weight to 120 tons. When the above structure is employed, it has actually become possible to accommodate 69 used nuclear fuel aggregates after satisfying the required weight limit and the size limit of the cask.

Figure 9:
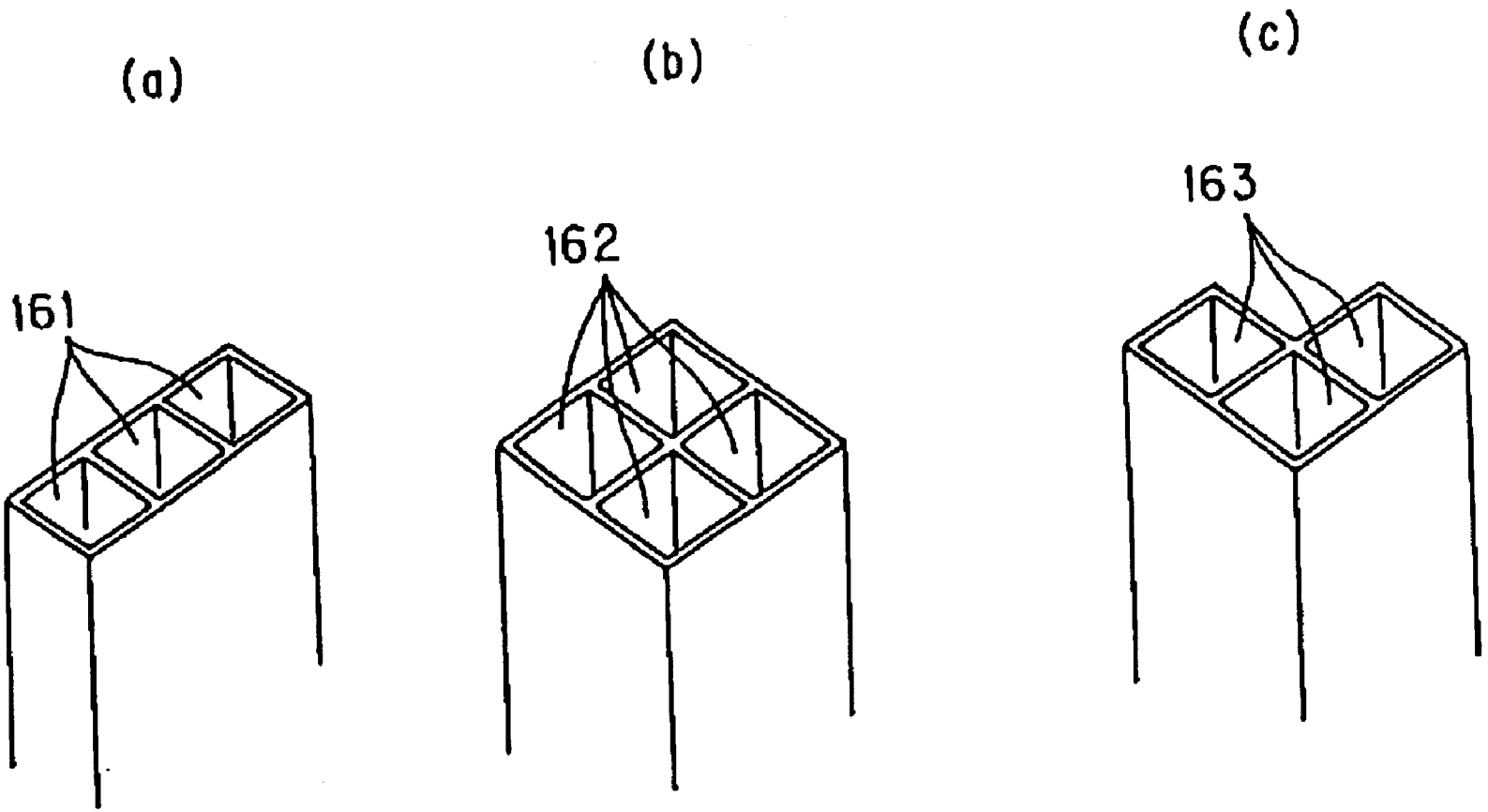
FIG. 9 shows perspective views of a modified example of a basket.

A modified example of the basket relating to the first embodiment of the invention will be explained next. FIG. 9 shows perspective views of a modified example of the basket. While the above-described angular pipe 132 has a simple pipe shape, the basket may also be shaped to have three continuous cells 161 as shown in FIG. 9(*a*). The basket may also have four continuous cells 162 formed in a square shape as a whole (see FIG. 9(*b*), or the basket may have three continuous cells 163 formed in an L-shape (see FIG. 9(*c*)). The above-described extrusion molding method may be used for manufacturing these angular pipes. In addition to these modified shapes, there may also be employed other shapes of the basket such as, for example, the basket having four continuous cells, those cells formed in a T-shape, etc. With this arrangement, it becomes easy to insert the angular pipes.

Figure 10:
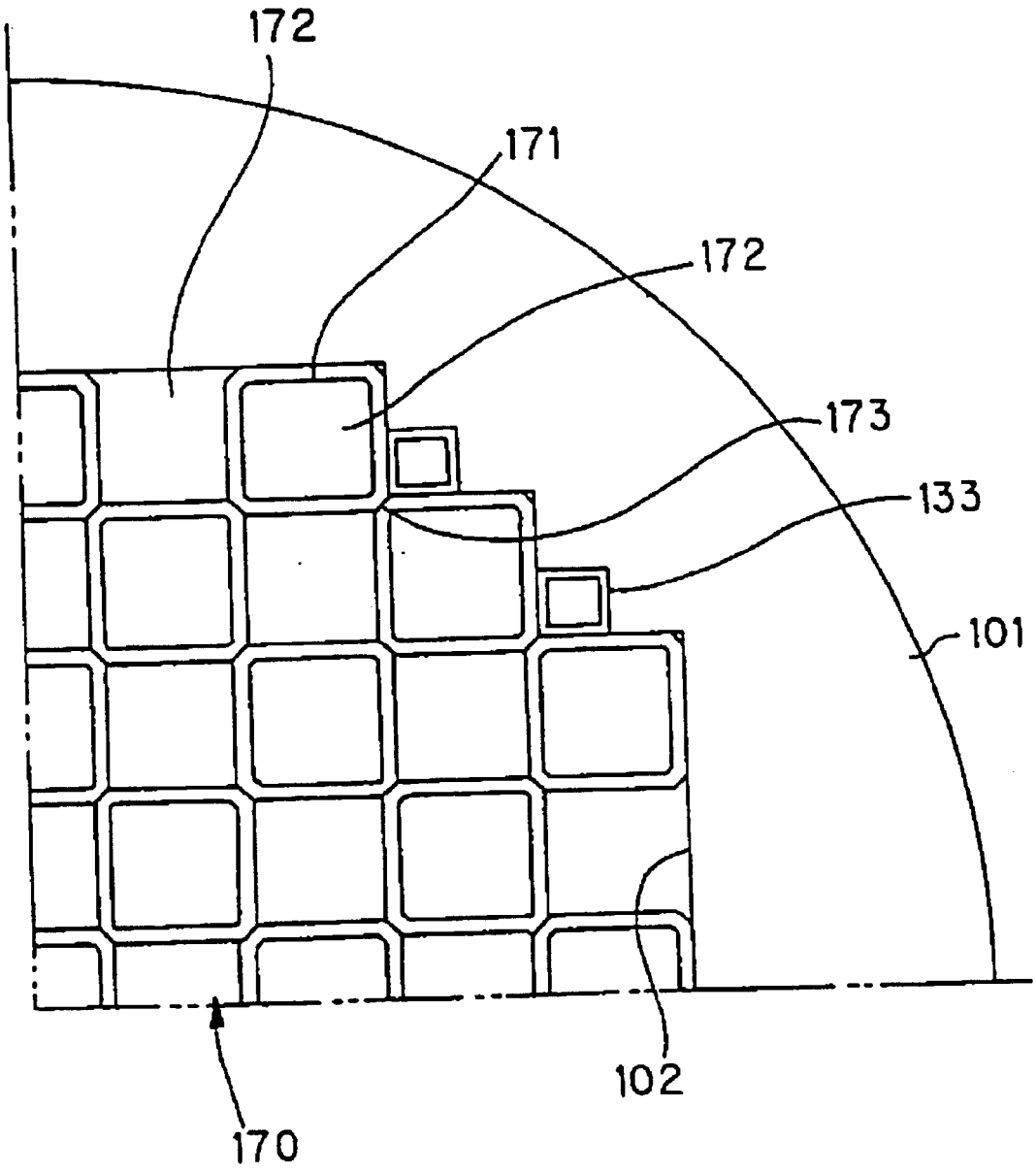
FIG. 10 is a top plan view showing another modified example of the basket.

FIG. 10 is a top plan view showing another modified example of the basket. This basket 170 has a structure that angular pipes 171 are laid out in a zigzag shape. Therefore, the cells 172 are formed by not only the inner surfaces of the angular pipes 171 but also by the outer surfaces of the adjacent angular pipes 171. At each corner portion of the angular pipe 171, a fillet 173 is provided. In a state that the angular pipes 171 have been inserted into the cavity 102, the fillets 173 of the adjacent angular pipes 171 are butted against each other, and this forms a constrained state as a whole. The thickness of each angular pipe is made larger than that of the angular pipe 132 in order to secure a predetermined neutron absorbing property. The dummy pipes 133 may be omitted in this case.

Figure 11:
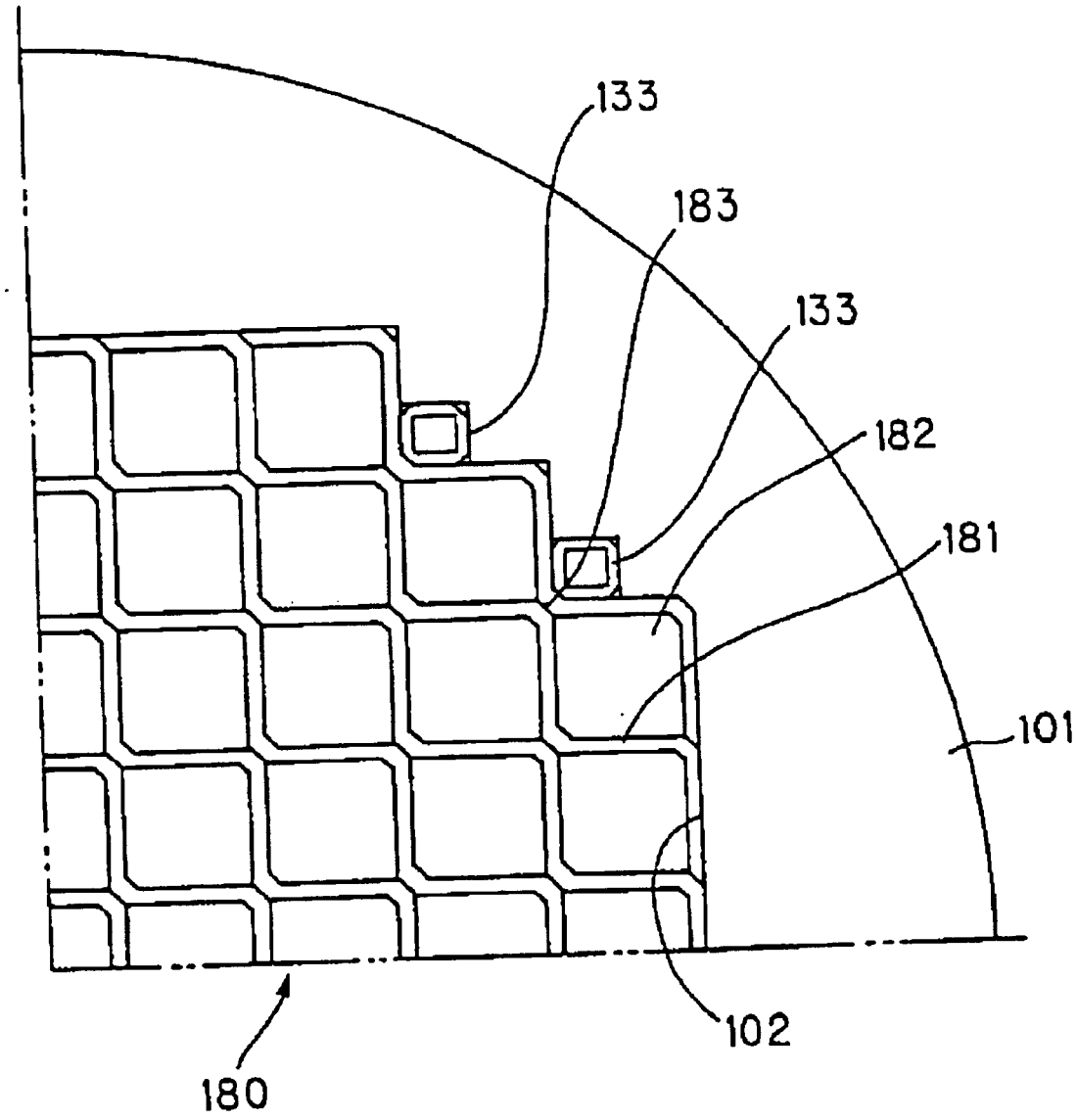
FIG. 11 is a top plan view showing still another modified example of the basket.

FIG. 11 is a top plan view showing still another modified example of the basket. As shown in this drawing, a basket 180 may be formed in a structure having cells 182 in a lattice shape by combining corrugated plates 181. A fillet 183 is provided at each corner portion of each corrugated plate 181. The corner portions are butted against the corner portions of the adjacent corrugated plates in a constrained state as a whole. An aluminum alloy including boron that has neutron absorbing property is used for the corrugated plate 181. The thickness of each angular pipe is also made larger than that of the angular pipe 132 in order to secure a predetermined neutron absorbing property. The dummy pipes 133 may be omitted in this case as well.

Figure 12:
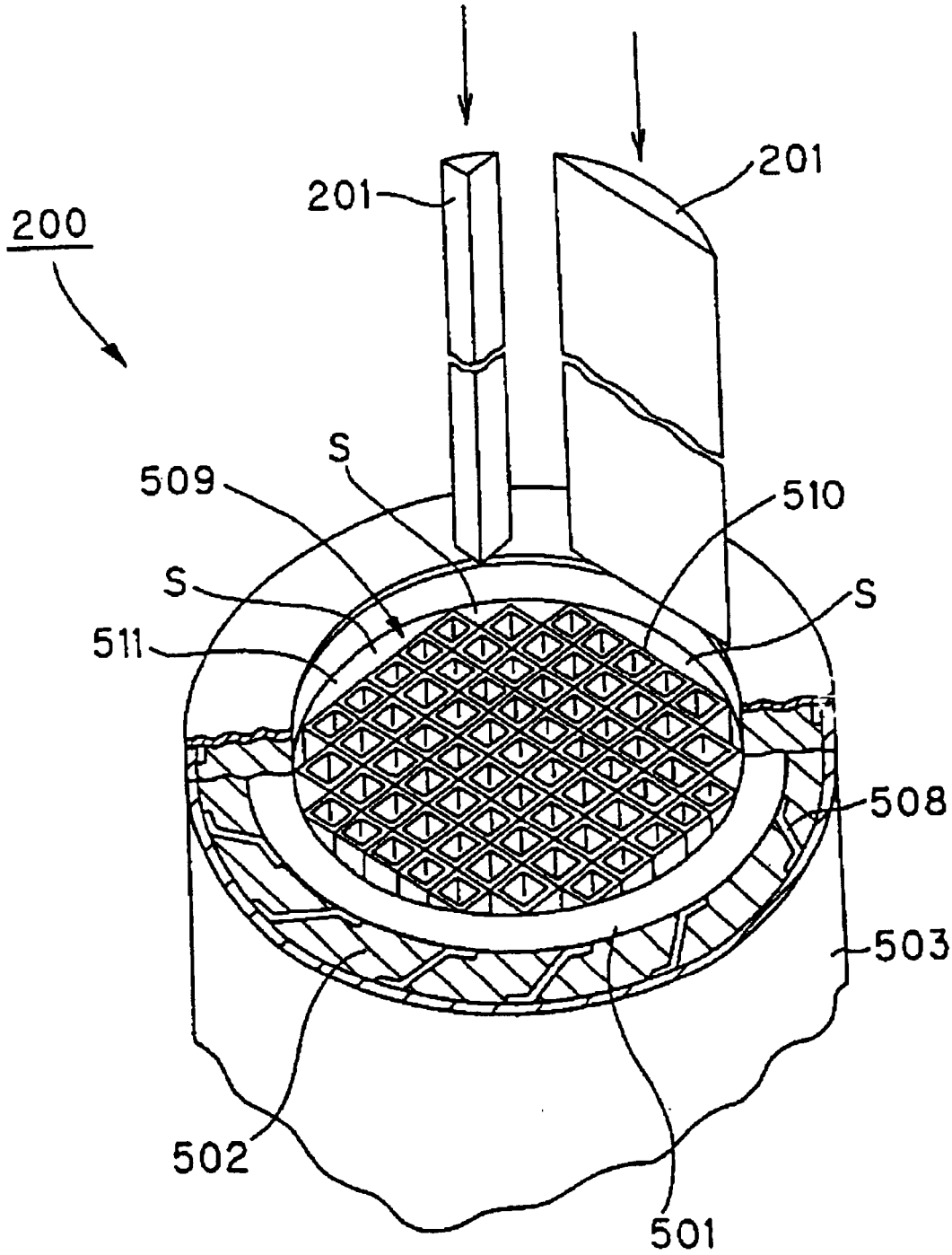
FIG. 12 is a perspective view showing a cask relating to a second embodiment of the present invention.

FIG. 12 is a perspective view showing a cask relating to a second embodiment of the present invention. This cask 200 has a structure that spacers 201 for thermal conduction are further provided on the cask 500 shown in FIG. 19. These spacers 201 fill space areas S, and efficiently conduct heat from angular pipes 510 to a shell main body 501. The material for the spacers 201 is carbon steel that is the same as the material for the shell main body 501. The spacers 201 are manufactured by casting or forging or by a mechanical processing according to the shapes of the space areas S.

According to this cask 200, as the space areas S are filled with the spacers 201, it becomes possible to improve the thermal conductivity. Further, as it is possible to improve the rigidness by the spacers 201, it becomes possible to make smaller the external shape of the shell main body 501. As a result, the cask 500 can be provided in compact and in lightweight.

Although the spacers 201 are inserted into the cavity 511 after the angular pipes 510 have been inserted into the cavity 511 in FIG. 12, the angular pipes 510 may be inserted after the spacers 210 have been fastened to the inside of the cavity 511 with bolts. Further, as a predetermined level of rigidness can be secured by the spacers 201, the external shape of the shell main body 501 may be made small by that amount.

Other material that can promote a thermal conduction can also be used instead of the spacers 201 shown in FIG. 12. For example, internal fins may be provided between the angular pipes 510 and the shell main body 501, and a resin maybe further provided between the internal fins (not shown). Alternatively, dummy pipes formed according to the shapes of the space areas S may be inserted (not shown).

Figure 13:
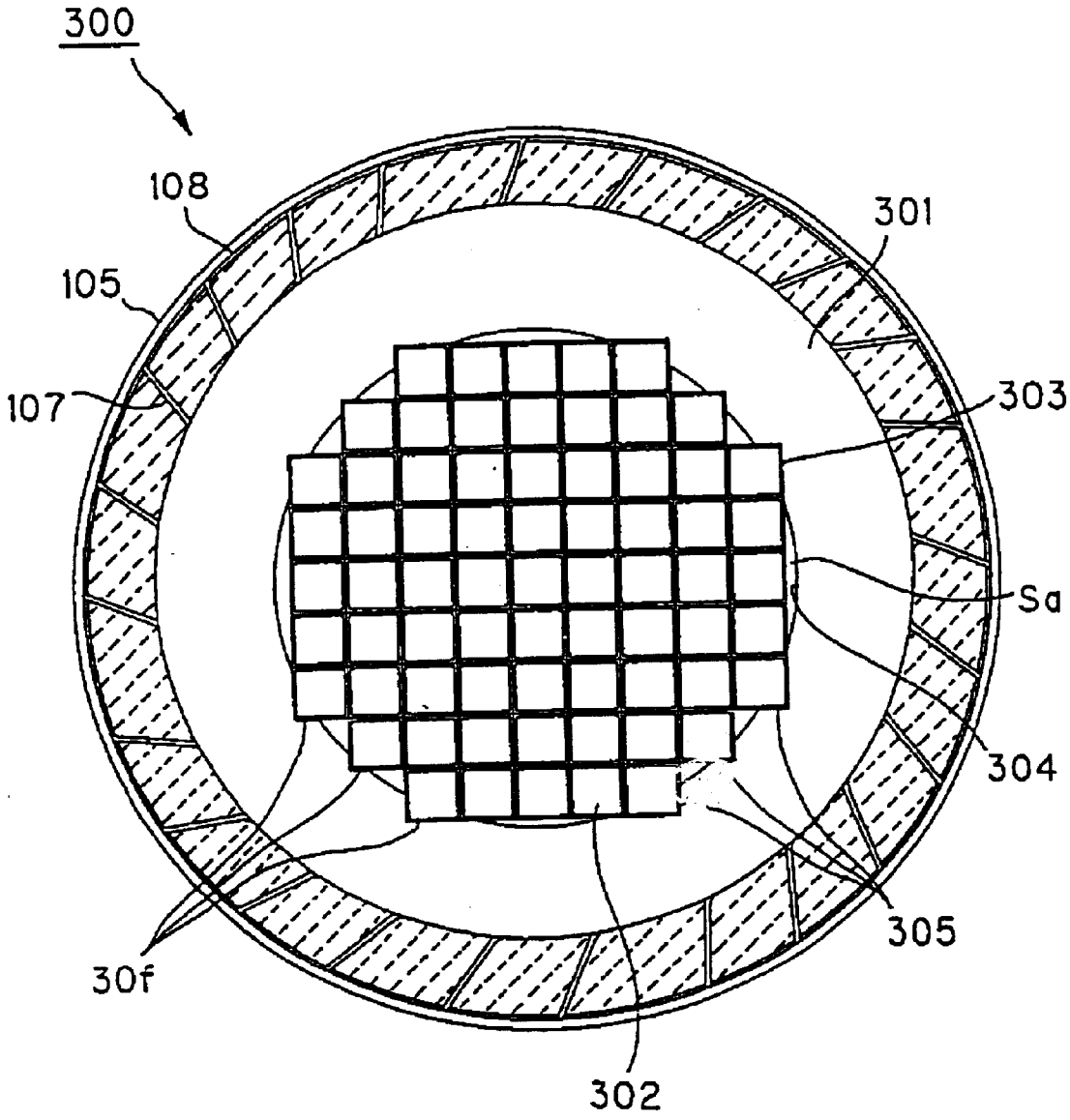
FIG. 13 is a cross-sectional view of a cask cut along a radial direction of the cask relating to a third embodiment of the present invention.

FIG. 13 is a cross-sectional view of a cask cut along a radial direction of the cask relating to a third embodiment of the present invention. According to a shell main body 301 of this cask 300, the inside of a cavity 304 is not plane processed to bring angular pipes 303 at the outer periphery into a complete contact with the cavity 304. Instead, the inside of the cavity 304, has been processed such that a part of the angular pipes 303 is brought into contact with the inner surface of the cavity 304 by remaining some space areas Sa. In other words, a plurality of grooves 305 are processed at twelve positions of a cylindrical inner surface of the cavity 304 to allow a part of the angular pipes 303 to be engaged with these grooves 305. According to this structure, it becomes possible to reduce the processing volume of the shell main body 301, which improves productivity. Further, the number of portions at which the angular pipes 303 are directly brought into contact with the shell main body 301 increases, and the space areas Sa within the cavity 304 can be made smaller. Therefore, it becomes possible to improve the thermal conductivity more than it is possible to improve by the cask 500 shown in FIG. 16, though the thermal conductivity is lower than that obtained from the cask 100 of the first embodiment. Further, it becomes possible to make the cask 300 in compact and in lightweight. Other constituent elements of this cask 300 are the same as those of the cask 100 of the first embodiment, and therefore, their explanation will be omitted.

Figure 14:
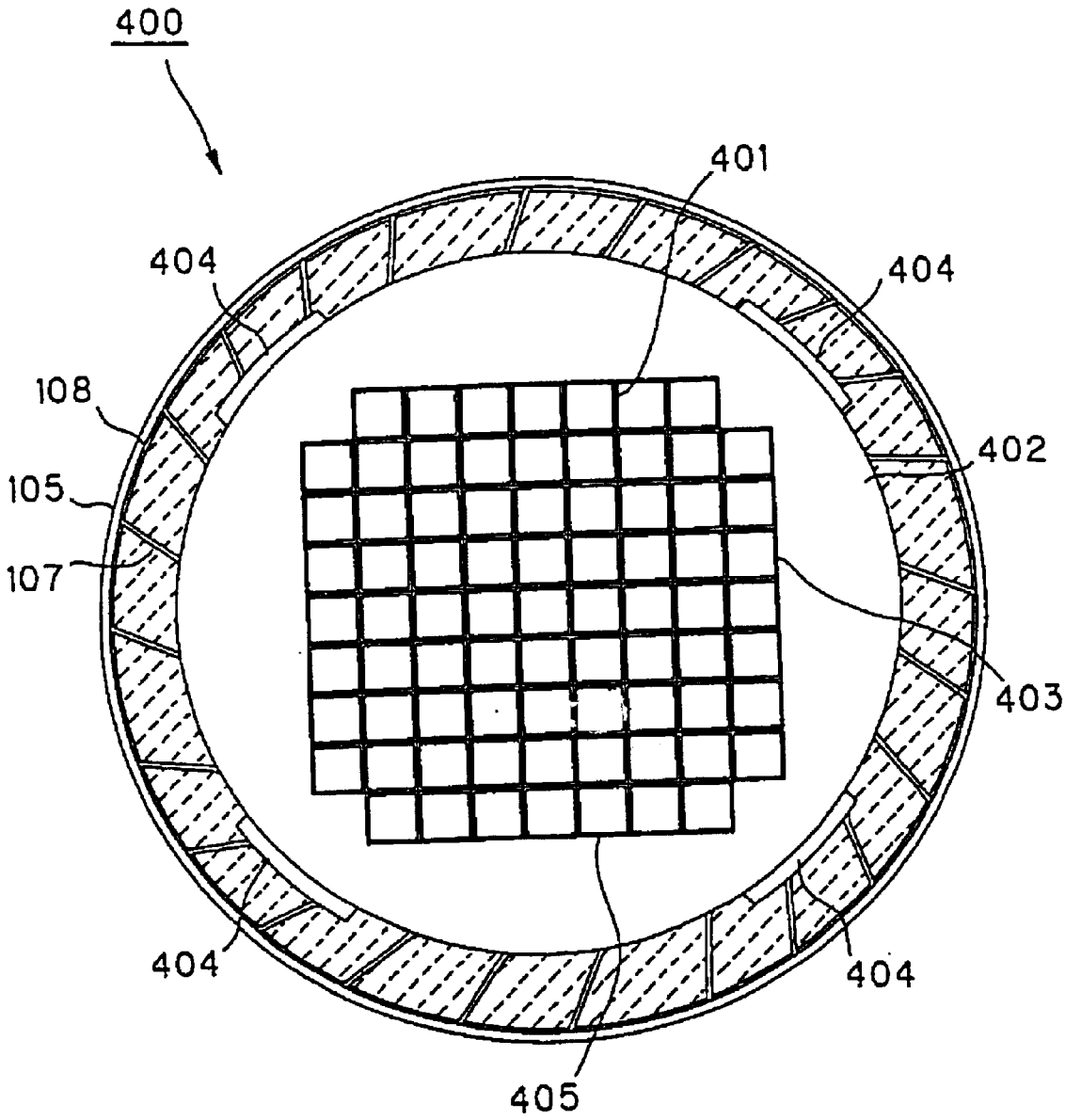
FIG. 14 is a cross-sectional view of a cask cut along a radial direction of the cask relating to a fourth embodiment of the present invention.

FIG. 14 is a cross-sectional view of a cask cut along a radial direction of the cask relating to a fourth embodiment of the present invention. This cask 400 is characterized in that the internal shape of the cavity shown in the first embodiment has been modified to enable 77 angular pipes 401 to be inserted into the cavity. In this structure, the thickness of a shell main body 402 becomes smaller at four corners of the cavity 403. Therefore, auxiliary shielding units 404 for shielding the γ-rays are provided at the four corners to reinforce the shell main body 402. These auxiliary shielding units 404 are made of carbon steel as the shell main body 401 is made of the same material.

Based on the above structure, it is possible to increase the number of cells of a basket 405. Therefore, it becomes possible to increase the number of accommodating used nuclear fuel aggregates. While the present embodiment shows 69 and 77 cells, the cells may be used by other numbers so long as the angular pipes 401 can be brought into contact with the inner surface of the cavity, subject to a condition that a predetermined weight and a predetermined external diameter can be secured. Other constituent elements of this cask 300 are 400 the same as those of the cask 100 of the first embodiment, and therefore, their explanation will be omitted.

Figure 15:
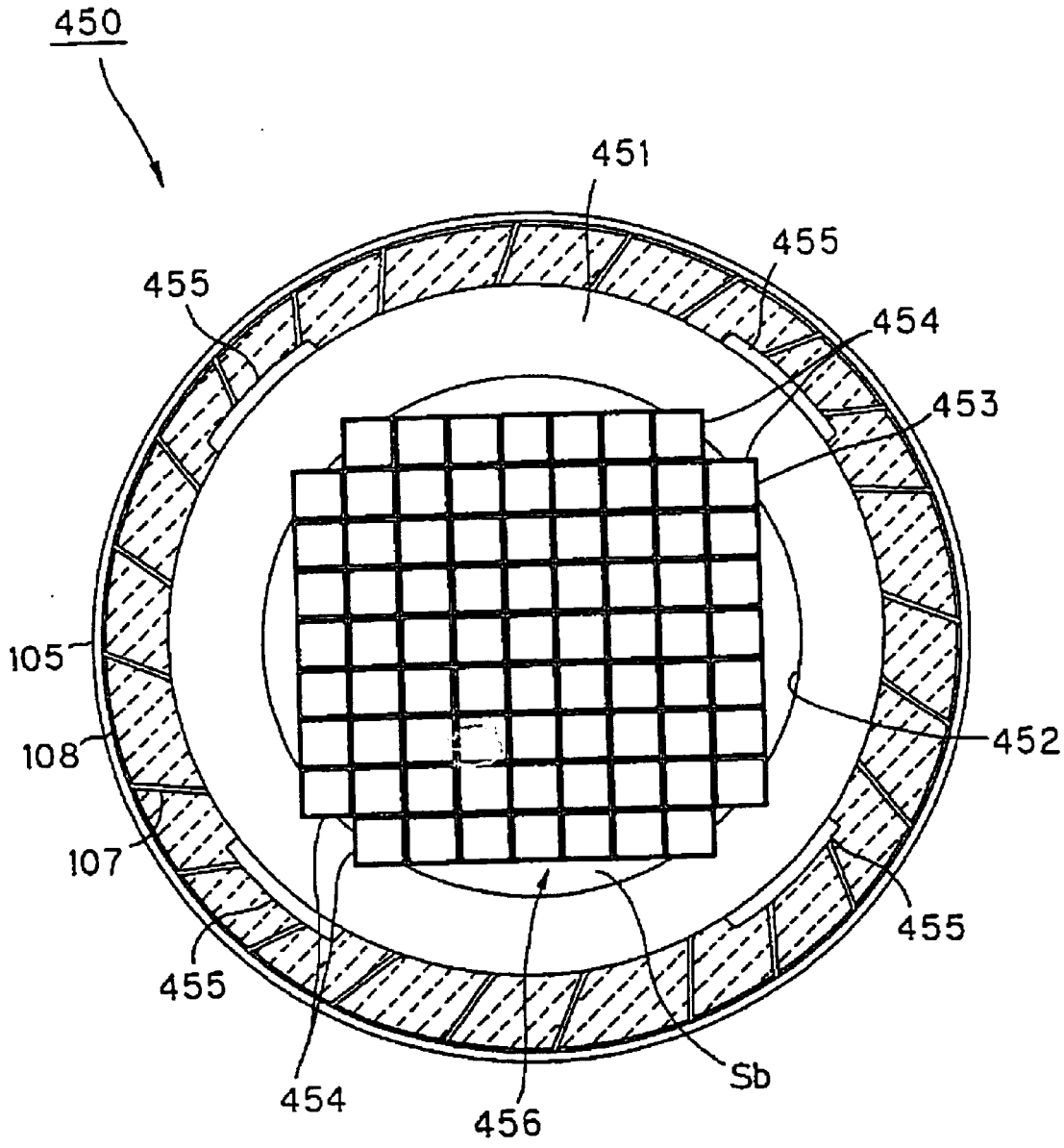
FIG. 15 is a cross-sectional view of another cask cut along a radial direction of the cask relating to the fourth embodiment of the present invention.

FIG. 15 shows other modified example. This cask 450 has a structure that eight grooves 454 are mechanically processed on the inner surface of a cavity 452 of a shell main body 451 to allow a part of angular pipes 453 to be engaged with these grooves, thereby increasing the number of accommodation of used nuclear fuel aggregates to 77. At portions where the thickness of the shell main body 451 becomes smaller, auxiliary shielding units 455 made of carbon steel for shielding the γ-rays are provided to reinforce the shell main body 455, in a similar manner as described above. Further, spacers (not shown) may be inserted into space areas Sb between a basket 456 and the shell main body 451 to match the shapes of these space areas. Other constituent elements of this cask 450 are the same as those of the cask 200 of the second embodiment, and therefore, their explanation will be omitted.

Figure 16:
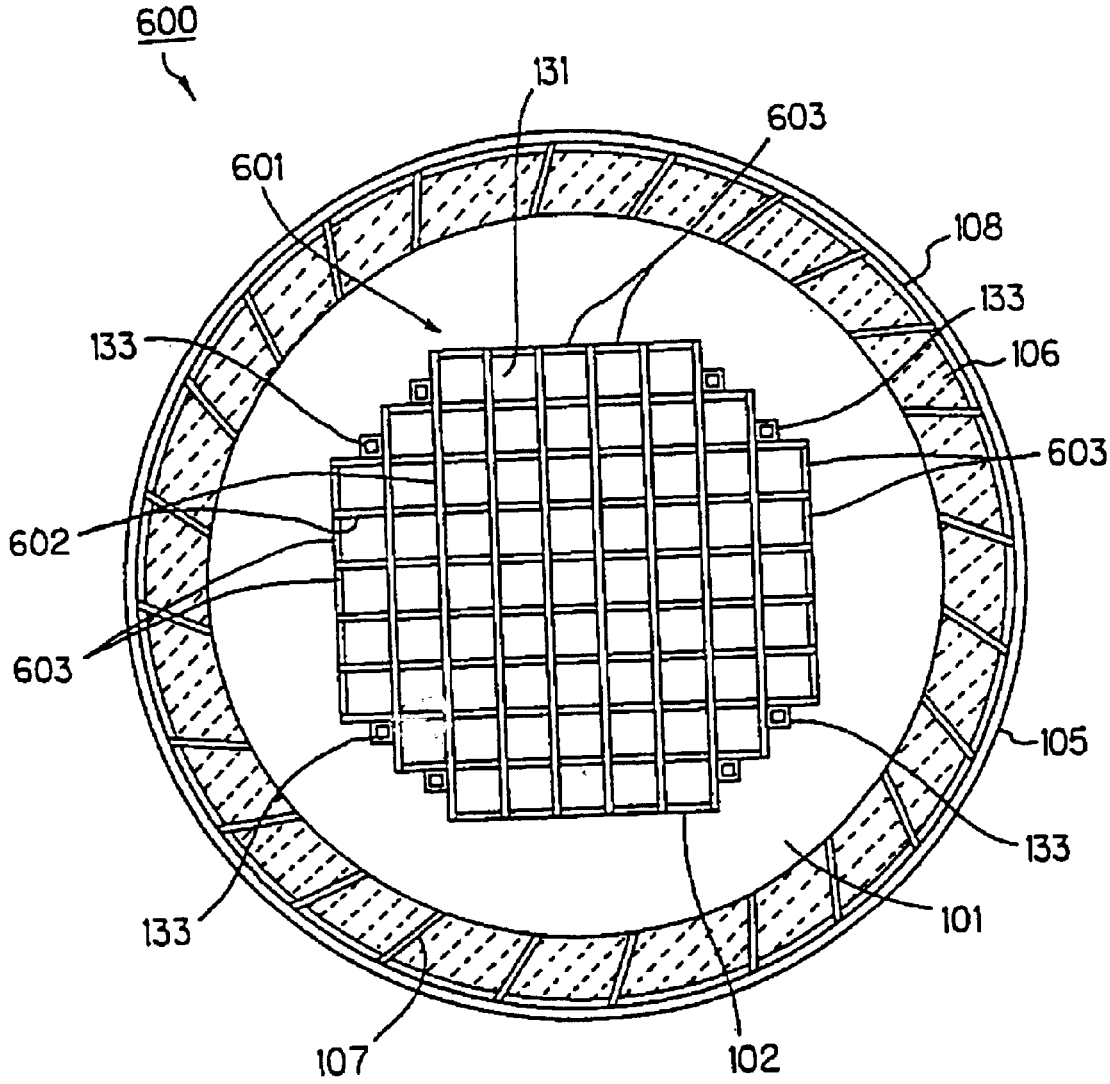
FIG. 16 is a cross-sectional view of a cask cut along a radial direction of the cask relating to a fifth embodiment of the present invention.
Figure 17:
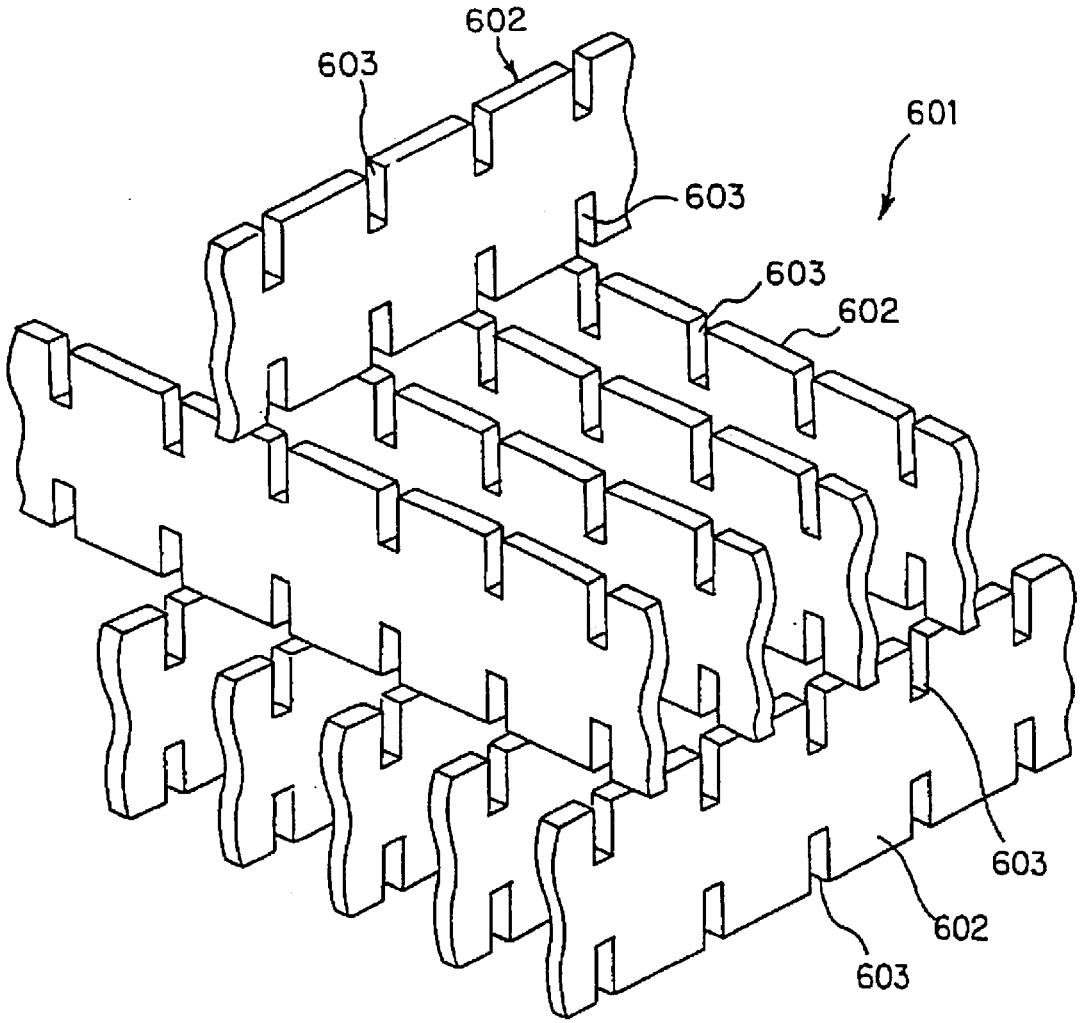
FIG. 17 is a view for explaining a structure of a basket of the cask shown in FIG. 16.
Figure 18:
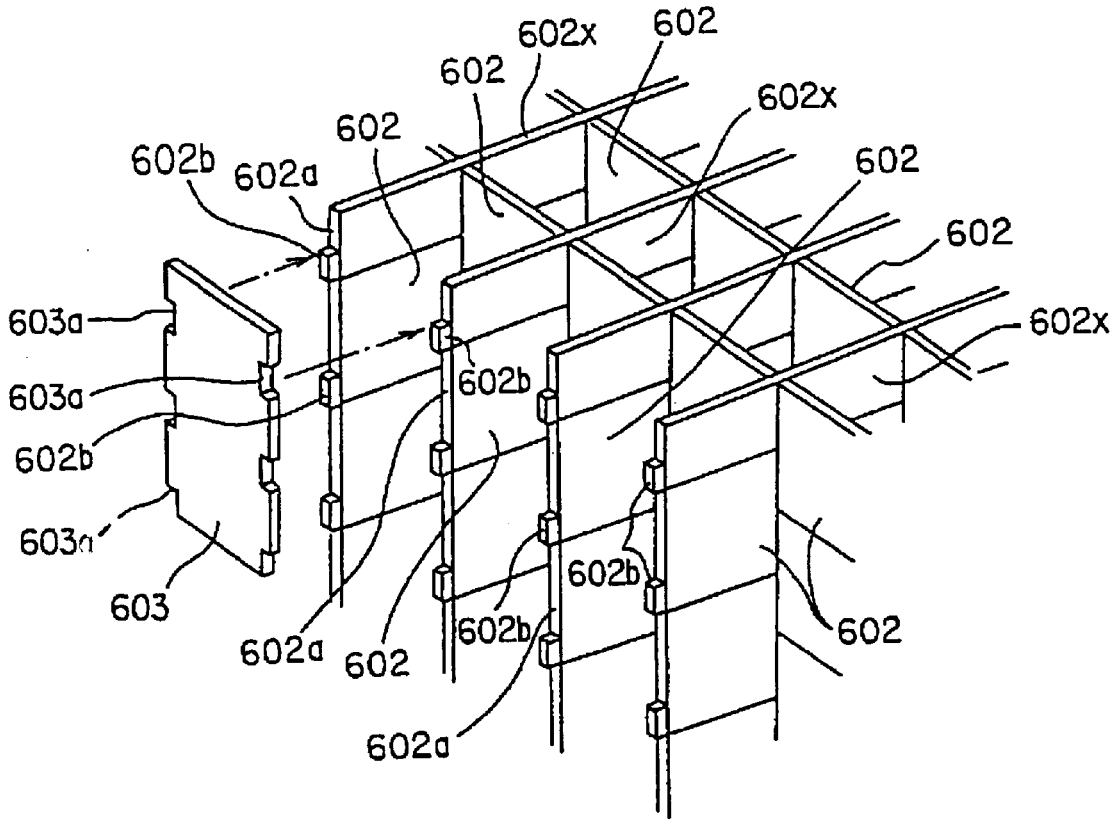
FIG. 18 is a view for explaining a structure of a basket of the cask shown in FIG. 16.

FIG. 16 is a cross-sectional view of a cask cut along a radial direction of the cask relating to a fifth embodiment of the present invention. FIG. 17 and FIG. 18 are views for explaining a structure of a basket of the cask shown in FIG. 16. This cask 600 is characterized in that a basket 601 is constructed by alternately combining a plurality of plates 602. In this combined status, the basket 601 is formed in approximately an angular cross section. A plurality of recesses 603 are formed on both sides of each plate 602 in its longitudinal direction. These plates 602 are combined together by mutually engaging the respective recesses 603.

Although not shown in the drawing, the end of each plate 602 in its longitudinal direction may be chamfered, or R may be formed on this end. Based on this arrangement, it is possible to smoothly insert used nuclear fuel aggregates into the basket 601 without a scratch in the middle of the basket 601. Thus, the basket 601 having a plurality of cells 131 can be formed based on an alternated combination of the plates 602. As shown in FIG. 18, of the plates 602 used at both ends of the basket 601, plates 602*x* at the side in one direction have their width in half. Therefore, the end of the basket 601 is formed in a plane.

For the plates 602, there are used an aluminum composite or an aluminum alloy that is prepared by adding a powder of boron or a boron compound having neutron absorbing property to a powder of Al or Al alloy. These plates 602 are manufactured by extrusion as explained in FIG. 4. The recesses 603 are formed by cutting or punching after the extrusion. Alternately, each plate 602 maybe in a structure that a boron plate has been adhered to an aluminum plate (not shown).

Further, a thermal conductive plate 603 is provided between ends 602*a* of the plates 602 that are positioned at the outer periphery of the basket 601 as shown in FIG. 18. Each thermal conductive plate 603 is fixed by engaging its recesses 603*a* with projections 602*b* provided at the end 602*a* of each plate 602, and fastening the thermal conductive plate with screws or by spot welding. Alternately, the thermal conductive plate 603 may be directly welded to the end surface of each plate, instead of providing the projections 602*b*. Based on these thermal conductive plates 603, it is possible to improve the thermal conductivity of decay heat generated from the used nuclear fuel aggregates from the plates 602 to a shell main body 101.

Further, dummy pipes 133 are inserted into both sides of angular pipe strings having five or seven cells in the cavity 102. These dummy pipes 133 are provided for the purpose of reducing the weight of the shell main body 101, making uniform the thickness of the shell main body 101, and ensuring the fixing of the basket 601. These dummy pipes 133 are also manufactured by using an aluminum alloy including boron in a process similar to that explained above. It is also possible to omit these dummy pipes 133. Other structures are the same as those of the first embodiment, and therefore, their explanation will be omitted. Constituent elements that are the same as those of the first embodiment are attached with identical reference numbers.

As explained above, according to the cask 600, the internal shape of the cavity is formed to match the angular cross section of the basket 601 that has been constructed by combining the plates 602. Therefore, it is possible to avoid the space area within the cavity 102. As a result, it is possible to make the shell main body 101 compact and to reduce its weight. On the other hand, when the external diameter of the shell main body 101 is set the same as that of the cask shown in FIG. 19, it is possible to secure cells by the number corresponding to this diameter. Therefore, it is possible to increase the number of accommodating the used nuclear fuel aggregates. Further, based on the provision of the thermal conductive plates 603, it is possible to effectively release the decay heat.

In the first to fifth embodiments, the description has been made based on the assumption that the used nuclear fuel aggregates of the PWR type atomic furnace are accommodated. It is also possible to employ a structure similar to that explained above when the used nuclear fuel aggregates of the BWR type atomic furnace are accommodated. In the case of the used nuclear fuel aggregates of the BWR type atomic furnace, it is necessary to increase the size of the latticed cells. In this case, the cells need not be arranged in order, and adjacent cells may be out of order, as they have been generally employed in the past.

As explained above, according to the cask of the present invention, the shape of the inside of a cavity of a shell main body that has a neutron shielding unit at its :outer periphery and shields the γ-rays is matched with the external shape of a basket that has latticed cells structured by a plurality of angular pipes having neutron absorbing property. Therefore, the angular pipes at the outermost side are brought into a plane contact with the inner surface of the cavity, and there is generated no space area between the angular pipes and the cavity. As a result, the thermal conductivity can be improved, and it also becomes possible to increase the number of accommodation of used nuclear fuel aggregates. Further, it becomes possible to make the cask in compact or in lightweight.

According to the cask of the next invention, a part of the inside of the cavity is matched with the external shape of the basket. Therefore, the thermal conductivity can be improved, though it is not so high as that obtained from the above-described cask, and it also becomes possible to increase the number of accommodation of used nuclear fuel aggregates. Further, it becomes possible to make the cask in compact or in lightweight.

According to the cask of the next invention, the shape of either one of the inner surface of a cavity of a shell main body that has a neutron shielding unit at its outer periphery and shields the γ-rays and the outer surface of a basket that has latticed cells structured by a plurality of angular pipes having neutron absorbing property, is matched with the shape of the other. Therefore, the thermal conductivity can be improved, and it also becomes possible to increase the number of accommodation of used nuclear fuel aggregates. Further, it becomes possible to make the cask in compact or in lightweight.

According to the cask of the next invention, dummy pipes are further provided, and the shape of a portion within the cavity that has room in the thickness of the shell main body is matched with the shape of the dummy pipes, whereby the dummy pipes are inserted into the cavity together with the basket in a state that the dummy pipes are in contact with the angular pipes. Therefore, it is possible to further reduce the weight of the cask, and it is possible to improve the thermal conductivity.

According to the cask of the next invention, auxiliary shielding units for shielding the γ-rays are further provided at portions of the outermost side of the shell main body that has a small thickness of the shell main body. Therefore, it is possible to obtain effects similar to those described above without lowering the γ-rays shielding capacity.

According to the cask of the next invention, spacers are provided between a basket and a cavity. Therefore, it is possible to improve the thermal conductivity of decay heat generated from the used nuclear fuel aggregates.

According to the cask of the next invention, a plurality of angular pipes that constitute the basket are integrated together before they are inserted into the cavity. Therefore, it becomes easy to assemble the cask. Further, as there is no contact interface between the angular pipes, it becomes possible to improve the thermal conductivity.

The cask of the next invention comprises a basket having a plurality of latticed cells formed for accommodating used nuclear fuel aggregates, by bundling a plurality of angular pipes having a neutron absorbing material added to a structural material; a shell main body having a cylindrical cavity that has been forged from a γ-rays shielding material, and that is plane processed by matching the shape of the inside of this cavity with the external shape of the basket formed by the angular pipes; and a neutron shielding unit having a plurality of internal fins extended between the shell main body and an external cylinder, and for shielding neutrons filled in a space formed by the shell main body, the external cylinder and the internal fins, whereby the angular pipe are sequentially inserted into the cavity to structure the basket while bringing the outer surface of the basket into contact with the inner surface of the cavity. Therefore, the thermal conductivity can be improved, and it also becomes possible to increase the number of accommodation of used nuclear fuel aggregates. Further, it becomes possible to make the cask in compact or in lightweight.

According to the cask of the next invention, the shape of the inside of a cavity of a shell main body that has a neutron shielding unit at its outer periphery and shields the γ-rays is matched with the external shape of a basket that has a latticed angular cross-sectional shape by alternately combining in an orthogonal direction a plurality of plates having neutron absorbing property. Further, each used nuclear fuel aggregate is accommodated in each cell of the basket inserted into the cavity. Therefore, it is possible to make smaller the external diameter of the shell main body. As a result, it is possible to make the cask compact or to reduce its weight.

According to the cask of the next invention, a part of the inside of the cavity is matched with the external shape of the basket. As a result, it is possible to make the cask compact or to reduce its weight, although not to such a high level achieved in the above cask according to the ninth aspect.

According to the cask of the next invention, dummy pipes are further provided, and the shape of a portion within the cavity that has room in the thickness of the shell main body is matched with the shape of the dummy pipes. Further, the dummy pipes are inserted into the cavity together with the basket in a state that the dummy pipes are in contact with the plates. As a result, it is possible to further reduce the weight of the cask, and to improve the thermal conductivity.

According to the cask of the next invention, when the basket is constructed by combining the plates, a thermal conductive plate is provided between the end of each plate positioned at the outer periphery of the basket and the end of the other plate. Therefore, it becomes possible to improve the thermal conductivity from the plates to the shell main body. As a result, it is possible to increase the number of accommodating the used nuclear fuel aggregates.

INDUSTRIAL APPLICABILITY

As explained above, the cask of the present invention is useful for improving the thermal conductivity of used nuclear fuel aggregates that have finished combustion, and for accommodating and storing the used nuclear fuel aggregates by increasing the accommodation number. Further, the cask of the present invention is compact and light weight.

What is claimed is:

1. A cask comprising:

a cylindrical shell main body having a cavity inside;

a neutron shielding unit at its outer periphery of the shell main body for shielding γ-rays; and a basket having an angular cross section that is structured by a plurality of angular pipes having neutron absorbing property for forming cells for accommodating used nuclear fuel aggregate, wherein a cross section of the cavity is matched with the angular cross section of the basket.

2. The cask according to claim 1, wherein a part of the inside of the cavity is matched with the external shape at the basket.

3. The cask according to claim 1, wherein dummy pipes are further provided, and a shape of a portion within the cavity that has room in a thickness of the shell main body is matched with the shape of the dummy pipes, whereby the dummy pipes are inserted into the cavity together with the basket in a state that the dummy pipes are in contact with the angular pipes.

4. The cask according to claim 1, wherein auxiliary shielding units for shielding the γ-rays are further provided at portions of an outermost side of the shell main body that has a small thickness of the shell main body.

5. The cask according to claim 1, wherein a plurality of angular pipes that constitute the basket are integrated together before they are inserted into the cavity.

6. A cask comprising:

a cylindrical shell main body having a cavity inside;

a neutron shielding unit at outer periphery of the shell main body for shielding γ-rays; and a basket that has latticed cells structured by a plurality of angular pipes having neutron absorbing property for forming cells for accommodating, used nuclear fuel aggregate, wherein a shape of either one of an inner surface of the cavity and an outer surface of the basket is matched with the shape of the other.

7. The cask according to claim 6, wherein dummy pipes are further provided, and a shape of a portion within the cavity that has room in a thickness of the shell main body is matched with the shape of the dummy pipes, whereby the dummy pipes are inserted into the cavity together with the basket in a state that the dummy pipes are in contact with the angular pipes.

8. The cask according to claim 6, wherein auxiliary shielding units for shielding the γ-rays are further provided at portions of an outermost side of the shell main body that has a small thickness of the shell main body.

9. The cask according to claim 6, wherein a plurality of angular pipes that constitute the basket are integrated together before they are inserted into the cavity.

10. A cask according to claim 6, wherein spacers are provided between the cavity and the basket.

11. The cask according to claim 10, wherein a plurality of angular pipes that constitute the basket are integrated together before they are inserted into the cavity.

12. A cask comprising:

a basket having a plurality of latticed cells formed for accommodating used nuclear fuel aggregates, constructed by bundling a plurality of angular pipes having neutron absorbing material added to a structural material;

a cylindrical shell main body having a cavity forged from a γ-rays shielding material, and having plane portions inside of the cavity that match an external shape of the basket; and a neutron shielding unit for shielding neutrons, having a plurality of internal fins extended between the shell main body and an external cylinder, the neutron shielding unit being filled in a space formed by the shell main body, the external cylinder, and the internal fins, wherein the angular pipes are sequentially inserted into the cavity to structure the basket while bringing the outer surface of the basket into contact with the inner surface of the cavity.

13. A cask comprising:

a cylindrical shell main body having a cavity inside;

a neutron shielding unit disposed at outer periphery of the shell main body for shielding γ-rays; and a basket having an angular cross section that is structured by a plurality of angular pipes having neutron absorbing property for forming cells for accommodating used nuclear fuel aggregate, wherein the cavity has an inner surface cut so as to match a cross section thereof with the angular cross section of the basket.

* * * * *